US009175445B2

(12) United States Patent
Smith et al.

(10) Patent No.: US 9,175,445 B2
(45) Date of Patent: Nov. 3, 2015

(54) METHODS FOR INSTALLING A BOUNDED PAVING SYSTEM

(71) Applicant: CPG International LLC, Skokie, IL (US)

(72) Inventors: Steven George Smith, St. Michael, MN (US); Troy Achterkirch, Rogers, MN (US); Steven John Thorkelson, Minnetonka, MN (US)

(73) Assignee: CPG International LLC, Skokie, IL (US)

( * ) Notice: Subject to any disclaimer, the term of this patent is extended or adjusted under 35 U.S.C. 154(b) by 0 days.

(21) Appl. No.: 14/690,733

(22) Filed: Apr. 20, 2015

(65) Prior Publication Data

US 2015/0259860 A1 Sep. 17, 2015

Related U.S. Application Data

(63) Continuation of application No. 14/196,353, filed on Mar. 4, 2014, now Pat. No. 9,011,036, which is a continuation of application No. 13/254,367, filed as application No. PCT/US2010/026263 on Mar. 4, 2010, now Pat. No. 8,696,234.

(60) Provisional application No. 61/157,468, filed on Mar. 4, 2009.

(51) Int. Cl.
*E01C 5/00* (2006.01)
*E01C 11/00* (2006.01)
(Continued)

(52) U.S. Cl.
CPC . *E01C 3/006* (2013.01); *E01C 5/04* (2013.01); *E01C 11/00* (2013.01); *E01C 15/00* (2013.01)

(58) Field of Classification Search
CPC ..... E01C 9/088; E01C 9/086; E01C 5/00; E01C 2201/02; E01C 2201/06; E02D 17/205
See application file for complete search history.

(56) References Cited

U.S. PATENT DOCUMENTS 123,219 A 1/1872 Beidler
321,403 A 6/1885 Underwood
(Continued)

FOREIGN PATENT DOCUMENTS

DE 29710241 8/1997
GB 2367086 3/2002
(Continued)

OTHER PUBLICATIONS

"U.S. Appl. No. 12/717,856, Corrected Notice of Allowability mailed Oct. 10, 2012", 5 pgs.
(Continued)

*Primary Examiner* — Abigail A Risic
(74) *Attorney, Agent, or Firm* — Schwegman Lundberg & Woessner, P.A.

(57) ABSTRACT

A method for installing a paver system includes positioning a first grid substrate adjacent to a second grid substrate, the first and second grid substrates form a paver support surface. At least the first grid substrate includes an integrated boundary ridge extending along the first paver support surface. The first grid substrate is interlocked with the second grid substrate with a first paver piece bridging the first and second grid substrates to form a paver linkage. Movement of at least the first paver piece is arrested beyond the integrated boundary ridge by directly or indirectly engaging at least the first paver piece against the integrated boundary ridge. In another example, movement of the first paver piece is arrested by anchoring at least the first paver piece on the first and second paver support surfaces through distribution of forces incident on at least the first paver piece through the paver linkage.

25 Claims, 13 Drawing Sheets

(51) Int. Cl.

| | |
|---|---|
| ***E01C 15/00*** | (2006.01) |
| ***E01C 3/00*** | (2006.01) |
| ***E01C 5/04*** | (2006.01) |

(56) References Cited

U.S. PATENT DOCUMENTS

| | | | |
|---|---|---|---|
| 401,030 | A | 4/1889 | Harger |
| 1,601,465 | A | 9/1926 | Barbour |
| 3,213,768 | A | 10/1965 | Lauritz |
| 3,233,896 | A | 2/1966 | Lee |
| 222,025 | A | 11/1979 | Devilliers |
| 4,655,018 | A | 4/1987 | Pardo |
| 4,885,882 | A | 12/1989 | Forshee |
| 5,226,273 | A | 7/1993 | Burke |
| 5,267,810 | A | 12/1993 | Johnson |
| 5,313,756 | A | 5/1994 | Ways et al. |
| 5,418,036 | A | 5/1995 | Tokikawa et al. |
| 5,429,451 | A | 7/1995 | Pettee, Jr. |
| 5,787,637 | A | 8/1998 | Keen |
| 5,850,720 | A | 12/1998 | Willis |
| 5,988,942 | A | 11/1999 | Atkinson |
| 5,993,107 | A | 11/1999 | Bauer |
| 6,055,784 | A | 5/2000 | Geiger |
| 6,071,041 | A | 6/2000 | Knight |
| 6,171,015 | B1 | 1/2001 | Barth |
| 6,233,896 | B1 | 5/2001 | Coup |
| D457,254 | S | 5/2002 | Stepanchick |
| 6,422,784 | B1 | 7/2002 | Pellegrino et al. |
| 6,508,607 | B1 | 1/2003 | Smith et al. |
| 6,551,016 | B2 | 4/2003 | Guidon |
| 6,558,070 | B1 | 5/2003 | Valtanen |
| 6,594,961 | B2 | 7/2003 | Leines |
| 6,769,217 | B2 | 8/2004 | Nelson |
| 6,851,236 | B1 | 2/2005 | Harvey |
| 6,872,434 | B2 | 3/2005 | Zen |
| 7,028,437 | B2 | 4/2006 | Hauck |
| 7,237,766 | B2 | 7/2007 | Lemay |
| 7,244,076 | B2 | 7/2007 | Whitson |
| 7,270,497 | B2 | 9/2007 | Von Langsdorff |
| 7,300,224 | B2 | 11/2007 | Slater |
| 7,344,334 | B2 | 3/2008 | Thorkelson |
| 7,441,378 | B2 | 10/2008 | Wood |
| D581,549 | S | 11/2008 | Thorkelson |
| 7,448,176 | B2 | 11/2008 | Drake |
| 7,503,146 | B2 | 3/2009 | Thomas |
| 7,918,623 | B2 | 4/2011 | Lacroix et al. |
| 8,128,312 | B2 | 3/2012 | Stuchell |
| 8,336,278 | B2 | 12/2012 | Smith et al. |
| 8,696,234 | B2 | 4/2014 | Smith et al. |
| 8,747,018 | B2 | 6/2014 | Smith et al. |
| 9,011,036 | B2 | 4/2015 | Achterkirch et al. |
| 2002/0095896 | A1 | 7/2002 | Commins et al. |
| 2002/0141821 | A1 | 10/2002 | Guidon |
| 2005/0284082 | A1 | 12/2005 | Smith |
| 2007/0269265 | A1 | 11/2007 | Thorkelson |
| 2008/0168732 | A1 | 7/2008 | Stuchell |
| 2010/0205899 | A1 | 8/2010 | Califano |
| 2010/0223880 | A1 | 9/2010 | Smith et al. |
| 2011/0052318 | A1 | 3/2011 | Smith et al. |
| 2011/0286793 | A1 | 11/2011 | Arguello |
| 2012/0034030 | A1 | 2/2012 | Smith et al. |
| 2012/0121328 | A1 | 5/2012 | White |
| 2014/0161527 | A1 | 6/2014 | Smith et al. |
| 2014/0186114 | A1 | 7/2014 | Smith et al. |

FOREIGN PATENT DOCUMENTS

| | | | |
|---|---|---|---|
| WO | WO-2009134237 | A1 | 11/2009 |
| WO | WO-2010102143 | A1 | 9/2010 |

OTHER PUBLICATIONS

"U.S. Appl. No. 12/717,856, Examiner Interview Summary mailed Apr. 11, 2012", 3 pgs.
"U.S. Appl. No. 12/717,856, Examiner Interview Summary mailed Aug. 1, 2012", 3 pgs.
"U.S. Appl. No. 12/717,856, Examiner Interview Summary mailed Dec. 2, 2011", 3 pgs.
"U.S. Appl. No. 12/717,856, Final Office Action mailed Jan. 19, 2012", 14 pgs.
"U.S. Appl. No. 12/717,856, Non Final Office Action mailed Apr. 26, 2012", 16 pgs.
"U.S. Appl. No. 12/717,856, Non Final Office Action mailed Sep. 9, 2011", 18 pgs.
"U.S. Appl. No. 12/717,856, Notice of Allowance mailed Aug. 17, 2012", 8 pgs.
"U.S. Appl. No. 12/717,856, Response filed Apr. 11, 2012 to Final Office Action mailed Jan. 19, 2012", 14 pgs.
"U.S. Appl. No. 12/717,856, Response filed Jul. 25, 2012 to Non Final Office Action mailed Apr. 26, 2012", 13 pgs.
"U.S. Appl. No. 12/717,856, Response filed Aug. 1, 2011 to Restriction Requirement mailed Jul. 13, 2011", 10 pgs.
"U.S. Appl. No. 12/717,856, Response filed Nov. 2, 2011 to Non Final Office Action mailed Sep. 2, 2011", 19 pgs.
"U.S. Appl. No. 12/717,856, Restriction Requirement mailed Jul. 13, 2011", 6 pgs.
"U.S. Appl. No. 12/990,419, Corrected Notice of Allowance mailed May 16, 2014", 2 pgs.
"U.S. Appl. No. 12/990,419, Examiner Interview Summary mailed Jun. 12, 2013", 3 pgs.
"U.S. Appl. No. 12/990,419, Examiner Interview Summary mailed Dec. 13, 2012", 3 pgs.
"U.S. Appl. No. 12/990,419, Final Office Action mailed Sep. 7, 2012", 21 pgs.
"U.S. Appl. No. 12/990,419, Non Final Office Action mailed Feb. 8, 2013", 20 pgs.
"U.S. Appl. No. 12/990,419, Non Final Office Action mailed Mar. 22, 2012", 22 pgs.
"U.S. Appl. No. 12/990,419, Notice of Allowance mailed Jul. 22, 2013", 6 pgs.
"U.S. Appl. No. 12/990,419, Notice of Allowance mailed Dec. 23, 2013", 6 pgs.
"U.S. Appl. No. 12/990,419, Preliminary Amendment filed Oct. 29, 2010 ", 3 pgs.
"U.S. Appl. No. 12/990,419, Response filed Jun. 4, 2013 to Non Final Office Action mailed Feb. 8, 2013", 16 pgs.
"U.S. Appl. No. 12/990,419, Response filed Jun. 22, 2012 to Non Final Office Action mailed Mar. 22, 2012", 17 pgs.
"U.S. Appl. No. 12/990,419, Response filed Nov. 11, 2011 to Restriction Requirement mailed Oct. 19, 2011", 14 pgs.
"U.S. Appl. No. 12/990,419, Response filed Dec. 13, 2012 to Final Office Action mailed Sep. 7, 2012", 23 pgs.
"U.S. Appl. No. 12/990,419, Restriction Requirement mailed Oct. 19, 2011", 5 pgs.
"U.S. Appl. No. 12/990,419, Supplemental Preliminary Amendment filed May 13, 2011".
"U.S. Appl. No. 13/254,367, Examiner Interview Summary mailed Apr. 3, 2013", 3 pgs.
"U.S. Appl. No. 13/254,367, Non Final Office Action mailed Oct. 5, 2012", 17 pgs.
"U.S. Appl. No. 13/254,367, Notice of Allowance mailed Nov. 22, 2013", 7 pgs.
"U.S. Appl. No. 13/254,367, Preliminary Amendment filed Sep. 1, 2011", 3 pgs.
"U.S. Appl. No. 13/254,367, Response filed Mar. 4, 2013 to Non Final Office Action mailed Oct. 5, 2012", 17 pgs.
"U.S. Appl. No. 13/254,367, Supplemental Preliminary Amendment filed Oct. 28, 2011", 9 pgs.
"U.S. Appl. No. 14/178,400, Non Final Office Action mailed Dec. 18, 2014", 6 pgs.
"U.S. Appl. No. 14/178,400, Response filed Mar. 18, 2015 to Non Final Office Action mailed Dec. 18, 2014", 20 pgs.
"U.S. Appl. No. 14/196,353, Non Final Office Action mailed Apr. 16, 2014", 6 pgs.

(56) References Cited

OTHER PUBLICATIONS

"U.S. Appl. No. 14/196,353, Notice of Allowability mailed Mar. 20, 2015", 2 pgs.
"U.S. Appl. No. 14/196,353, Notice of Allowance mailed Dec. 5, 2014", 6 pgs.
"U.S. Appl. No. 14/196,353, Response filed Jul. 7, 2014 to Non Final Office Action mailed Apr. 16, 2014", 15 pgs.
"Canadian Application Serial No. 2,748,549, Response filed Aug. 7, 2013 to Office Action mailed Feb. 7, 2013", 18 pgs.
"Canadian Application Serial No. 2748549, Office Action mailed Feb. 7, 2013", 3 pgs.
"International Application Serial No. PCT/US2008/013153, International Search Report mailed Mar. 20, 2009", 3 pgs.
"International Application Serial No. PCT/US2008/013153, Written Opinion mailed Mar. 20, 2009", 8 pgs.
"International Application Serial No. PCT/US2010/026263, International Search Report mailed Apr. 30, 2010", 2 pgs.
"International Application Serial No. PCT/US2010/026263, Written Opinion mailed Sep. 15, 2011", 7 pgs.
US 8,714,868, 05/2014, Smith et al. (withdrawn)

METHODS FOR INSTALLING A BOUNDED PAVING SYSTEM

RELATED APPLICATIONS

This application is a continuation of U.S. patent application Ser. No. 14/196,353, filed Mar. 4, 2014, which is a continuation of U.S. patent application Ser. No. 13/254,367, filed Oct. 17, 2011, and issued as U.S. Pat. No. 8,696,234 on Apr. 15, 2014, which application is a U.S. National Stage Filing under 35 U.S.C. 371 from International Application Serial No. PCT/US2010/026263, filed 4 Mar. 2010, and published as WO 102143 A1 on 10 Sep. 2010, which application claims priority to U.S. Provisional Patent Application Ser. No. 61/157,468 filed on Mar. 4, 2009, which applications and publications are incorporated herein by reference in their entirety.

This document is related to U.S. Provisional Patent Application Ser. No. 61/049,654 and PCT Application Serial No. PCT/US2008/013153 both of which are incorporated herein by reference.

TECHNICAL FIELD

Paving systems and bricks for residential, commercial and municipal applications.

BACKGROUND

Paver systems are used in landscaping and outdoor construction. Construction pavers are used in residential, commercial, and municipal applications that include walkways, patios, parking lots, and road ways. In some cases, pavers are made from a cementitious mix (i.e., concrete) or clay and are traditionally extruded or molded into various shapes.

The typical manner of installing cementitious or clay pavers is labor intensive, time consuming, and generally includes substantial overhead equipment costs. The simple shapes of cementitious or clay pavers limit their installation to an intensive manual process. Pavers are laid over a bed of sand and tapped into place with adjacent pavers. Where the pavers do not perfectly fit a specified area, for instance a measured out bed for a sidewalk or patio, the pavers are cut with a powered saw to fit within the specified area. Alternatively, the installer must refit and retap each preceding paver to fit within the specified area. Further, over time pavers shift on the underlying surface and break up aesthetic paver patterns or create gaps between pavers in the paving surface. A laborer must then rearrange the shifting pavers and may need to relay a large portion of the paving surface. Because of these issues the costs for cementitious pavers and their installation are therefore high and include intensive manual labor.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1A:
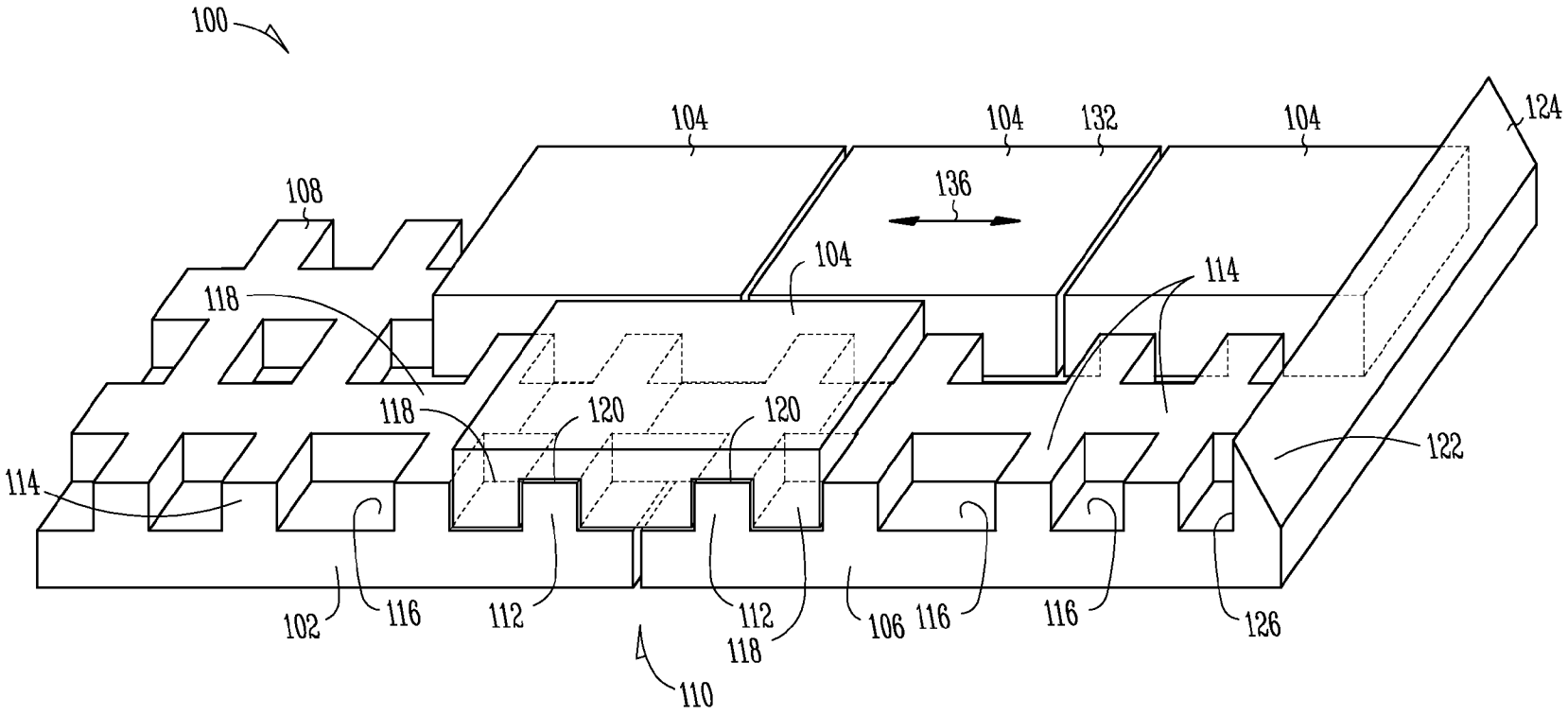
FIG. 1A is an isometric view showing one example of a bounded paving system including a grid substrate having an integrated boundary ridge.

Referring to FIG. 1A, one example of a paving system 100 is shown including a plurality of paver pieces 104 and grid substrates 102, 106. The paver pieces 104, when coupled with the grid substrates, present an upper paving surface 132 formed by the paver pieces in a decorative pattern. The grid substrates 102, 106 are coupled together by at least one paver piece 104 bridging between the grid substrate 102 and grid substrate 106. As will be described in further detail below, coupling of one or more paver pieces 104 between the grid substrates 102, 106 interlocks the grid substrates and paver pieces 104 and forms a paver linkage 110. The grid substrates 102, 106 include a paver surface 108 along the upper surface of the grid substrates. The paver surface 108 includes a non-planar undulating surface having recesses and projections sized and shaped to interfit with the paver pieces 104. The interfit between the paver pieces 104 and the grid substrates 102, 106 securely locks the paver pieces along the paver surface 108 and thereby facilitates transmission of incident forces on the paver pieces through the paver linkage. As discussed below, the transmission of forces through the linkage 110 anchors the paver pieces 104 and substantially prevents the undesired movement of any subset of paver pieces of the paving system 100 that experience forces (e.g., from tire rotation and the like).

Where some amount of clearance is left between the interlocking features of paver pieces 104 and the grid substrates 102, 106 movable joints 112 are formed therebetween. The movable joints 112 allow for articulation of the paver linkage 110 at the juncture between the grid substrates 102, 106. With tolerance at the interfitting between the paver pieces 104 and the grid substrates 102, 106, the moveable joints 112 allow for one or more of expansion and contraction of the paver linkage 110. In another example, tolerance at the moveable joints 112 permits rotation of the grid substrates 102, 106 relative to one another thereby allowing for horizontal undulation (e.g., curving of the paver linkage). For instance, where the installer desires a decorative, curved appearance for the paver pieces 104 or prefers to wrap the paving system 100 around a feature, such as a rock bed, the installer articulates the paver linkage 110 at the junctures between the grid substrates 102, 106.

Referring again to FIG. 1A, the paver pieces 104 are interlocked with the grid substrates 102, 106 through interfitting of the grid projections 114 with the paver recesses 120 and corresponding interfitting of the paver projections 118 with the grid recesses 116. The grid substrates 102, 106 include the grid projections 114 and grid recesses 116 and the paver pieces 104 include the corresponding paver projections 118 and paver recesses 120. As previously described above, in some examples, the paver pieces 104 and grid substrates 102, 106 are constructed in such a manner to provide tolerance between the grid projections 114 and the paver recesses 120 and corresponding tolerance between the grid recesses 116 and paver projections 118. The tolerance between the projections and recesses allows for articulation of the paver linkage 110 at movable joints 112 as shown in FIG. 1A.

In an example shown in FIG. 1A, the grid substrate 106 is a boundary grid substrate including an integrated boundary ridge 122. The integrated boundary ridge 122 extends continuously along at least one edge of the boundary grid substrate 106 and includes an exterior face 124 and an interior face 126. In other examples, the integrated boundary ridge 122 extends along a portion of the boundary grid substrate 106. For example, the integrated boundary ridge 122 extends intermittently along an edge of boundary grid substrate 106. The interior face 126 of the integrated boundary ridge 122 is sized and shaped to engage with the paver pieces 104 positioned on the boundary grid substrate 106. Where the boundary grid substrate 106 includes grid projections 114 and grid recesses 116, the interior face 126 cooperates with the projections and recesses 114, 116 to position the paver piece 104 on the boundary grid substrate 106 and hold the paver piece in place on the boundary grid substrate.

As will be described in further detail below, the integrated boundary ridge 122 frames the area of the paving system 100 and provides a bounded edge to the paving system 100. The integrated boundary ridge 122 cooperates with the interlocking of the substrates 102, 106 as well as the friction forces incident on the substrates 102, 106 and paver pieces 104 to statically position the paver pieces 104 and thereby substantially prevent disengagement of the paver pieces from the paving system 100 (e.g., disengagement caused by forces applied along the paver pieces 104 such as, tire rotation, pedestrian traffic and the like).

In other respects the boundary grid substrate 106 is substantially similar to the grid substrate 102. For instance, the boundary grid substrate 106 includes grid projections 114 and grid recesses 116 configured in a similar manner to the corresponding projections and recesses on the grid substrate 102. The similar projections and recesses on the grid substrate 102 and boundary grid substrate 106 ensure the paver pieces 104 are uniformly positionable over the paver surfaces 108 of the grid substrates to create a corresponding uniform decorative appearance with the paver pieces 104 once the paver pieces 104 are installed in the paving system 100.

The grid substrates 102, 106 and the paver pieces 104 are formed, in one example, with recycled post consumer material including butyl rubber. In another example, the grid substrates 102, 106 and paver pieces 104 are formed with recycled polymer materials that are molded into the shape of the paver pieces and grid substrates. In still another example, the paver pieces 104 and grid substrates 102, 106 are formed with a different process including but not limited to extrusion pultrusion and the like. In yet another example, where the paver pieces 104 and grid substrates 102, 106 are formed with the process including extrusion or pultrusion some of the projections 118 and 114 that are perpendicular or at an angle to the direction of extrusion or pultrusion are omitted from the paver pieces 104 and grid substrates 102, 106 to facilitate manufacturing in a lineal manner. In such an arrangement the paver pieces 104 are coupled along the grid substrates 102, 106 and slidable along longitudinally extending paver projections 108.

Figure 1B:
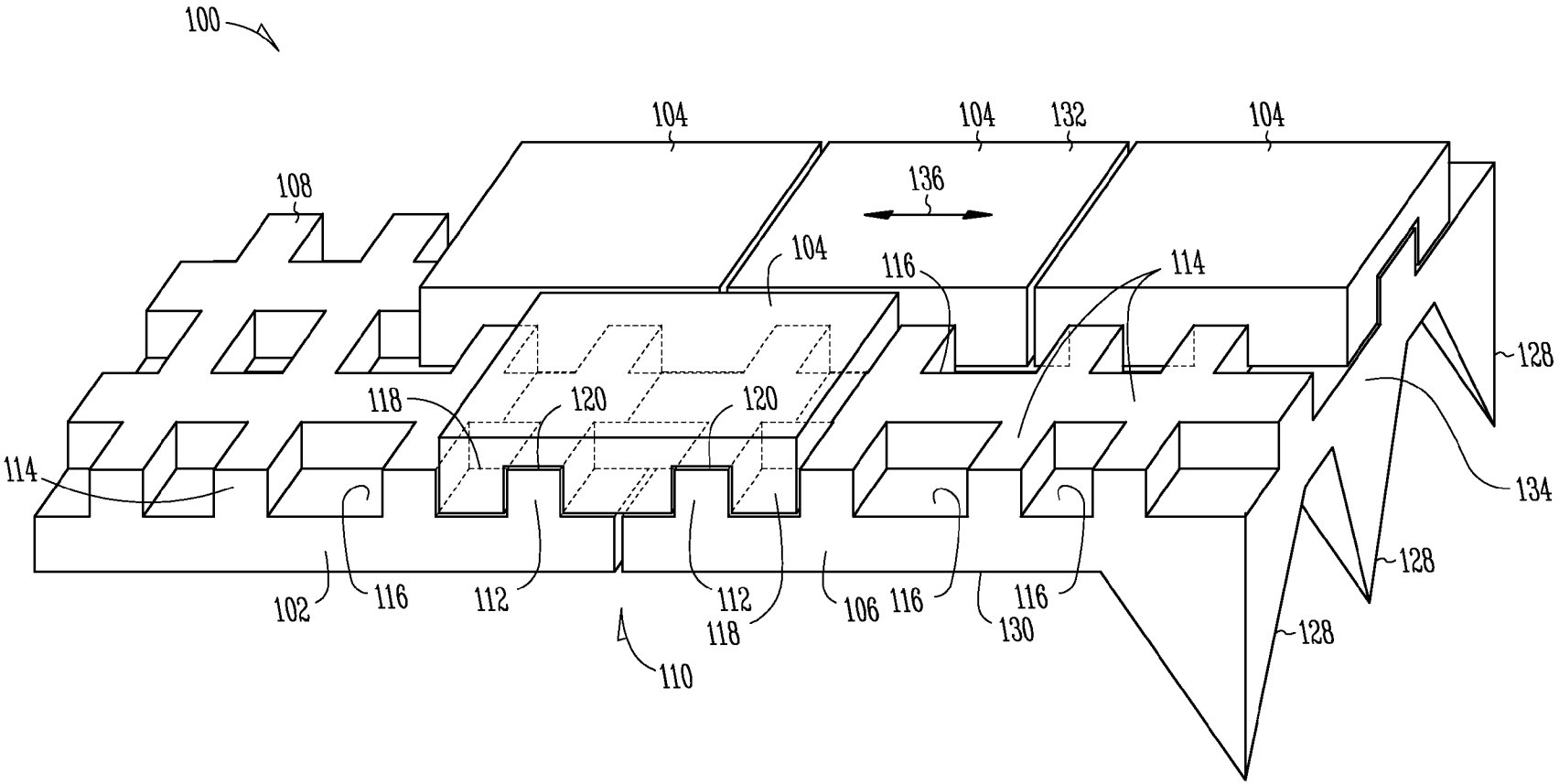
FIG. 1B is an isometric view showing another example of a bounded paving system including a grid substrate having an integrated stake.

FIG. 1B shows another example of a paver system 100. In the example shown in FIG. 1B many of the features shown in the paver system 100 in FIG. 1A are similar and elements referred to with the same reference number in the description of FIG. 1B refer to similar features. As previously discussed, the paver system 100 includes two or more grid substrates 102, 106 with a plurality of paver pieces 104 coupled over a paver surface 108. The paver surface 108 in one example includes grid projections and grid recesses 114, 116 sized and shaped to engage with corresponding projections and recesses 118, 120 of the paver pieces 104. At least one of the paver pieces 104 is shown in FIG. 1B coupled across (e.g., bridging) the grid substrate 102 and boundary grid substrate 106. As also described above, the coupling of the paver piece 104 across the grid substrates 102, 106 forms a paver linkage 110. The paver linkage 110 is configured to transmit forces incident on individual paver pieces 104 throughout the paver linkage 110 and thereby retain the paver pieces 104 at the location arranged on the paver surface 108 when the paver system 100 is installed.

The boundary grid substrate 106 shown in FIG. 1B includes one or more integrated stakes 128 extending from the boundary grid substrate. The integrated stakes 128 extend from the boundary grid substrate 106 along a grid substrate lower surface 130. The integrated stakes 128 are sized and shaped for piercing of an underlying surface positioned below the grid substrates 102, 106. Piercing of the grid substrates through the underlying surface affirmatively anchors the boundary grid substrate 106 in the underlying surface and thereby minimizes movement of the boundary grid substrate 106 when forces are incident upon the upper paver surface 132 formed by the paver pieces 104. The integrated stakes 128 cooperate with the paver linkage 110 to provide enhanced anchoring of the paver pieces 104 as well as the grid substrates 102, 106 in the orientation in which the paver system 100 is installed. Stated another way, the integrated stake 128 much like the integrated boundary ridge 122 shown in FIG. 1A cooperates with the paver linkage 110 to substantially minimize movement of the plurality of paver pieces 104 relative to the grid substrates 102, 106. Further, the integrated stakes 128 cooperate with the paver linkage 110 (again in the same manner as the integrated boundary ridge 124) to minimize movement of the grid substrates 102, 106 relative to the plurality of paver pieces 104. The integrated stakes 128 and integrated boundary ridge 122 thereby work with the paver linkage 110 to retain the paver pieces 104 and grid substrates 102, 106 in the desired orientation formed by the paver pieces during installation of the paver system 100.

As shown in FIG. 1B, the integrated stakes 128 are formed adjacent to a boundary grid edge 134 of the boundary grid substrate 106. In another example, the integrated stakes 128 are formed on another portion of the boundary grid substrate 106, for instance, intermediately between the edges of the boundary grid substrate 106 or, in yet another example, near the grid substrate 102. The integrated stakes 128 in any of these positions anchor the boundary grid substrate 106 in the underlying surface and thereby assist in holding the plurality of paver pieces 104 and grid substrates 102 in the installed orientation.

Figure 1C:
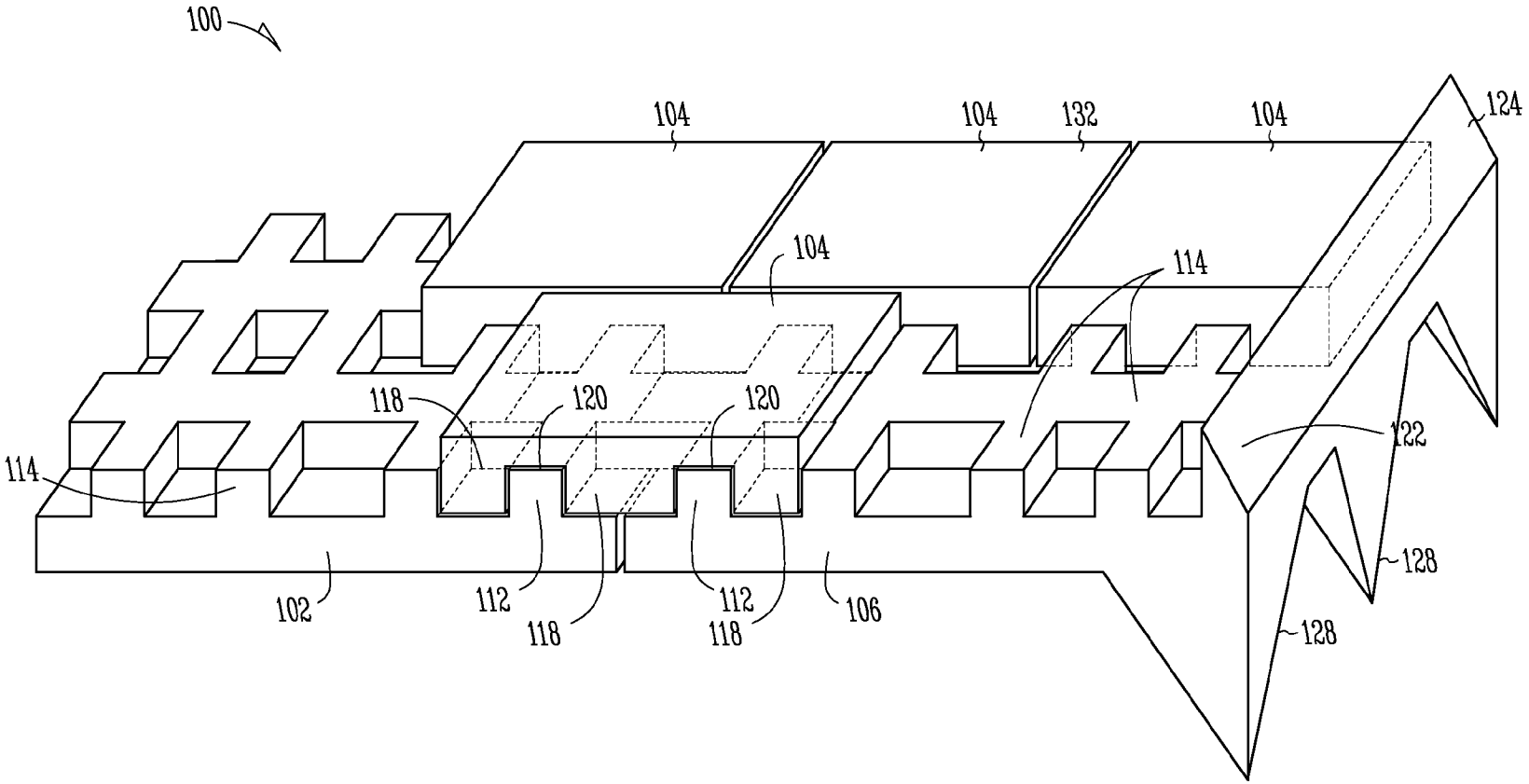
FIG. 1C is an isometric view showing still another example of a bounded paving system including a grid substrate having both an integrated boundary ridge and an integrated stake.

In both of the examples described above and shown in FIGS. 1A and 1B, the boundary grid substrate 106 consolidates a grid substrate such as grid substrate 102 with the integrated boundary ridge 122 or the integrated stake 128. As discussed below, the integrated stake 128 and integrated boundary ridge 122 are combined into a single boundary grid substrate 106 as shown in FIG. 1C. By integrating one or more of the integrated boundary ridge 122 and integrated stake 128 with the boundary grid substrate 106 installation of the boundary grid substrate is consolidated in contrast to separate installation of the boundary ridge or integrated stake with a grid substrate and paver pieces. Consolidated installation of the integrated boundary ridge 122 and the integrated stake 128 minimizes installation cost and time for the paver system 100.

Because the boundary ridge 122 and stake 128 are integrated with the boundary grid substrate 106, lateral forces incident upon any of the plurality of paver pieces 104 coupled with the boundary grid substrate (e.g., from tire rotation) are transmitted at least to the boundary grid substrate 106 as well as the boundary ridge 122 and the stake 128. These lateral forces are distributed across the boundary grid substrate 106 and minimize movement of the paver pieces receiving the initial application of force. Stated another way, as lateral forces are incident against the plurality of paver pieces 104, because the lateral forces incident on the paver pieces are transmitted to at least one of the integrated boundary ridge 122 or integrated stake 128 formed with the boundary grid substrate 106, those lateral forces are necessarily transmitted not only to the ridge 122 and stake 128, they are also transmitted to the boundary grid substrate 106 and are thereby opposed by the combined weight of the plurality of paver pieces lying over the boundary grid substrate 106 as well as the weight of the boundary grid substrates 106 and the corresponding friction forces generated according to the combined weight. In contrast, where a paving system includes separately formed stakes and boundary edging, lateral forces are transmitted directly to the stakes and without transmission to grid substrates. That is to say, the edging and stakes experience the full lateral force and are thereby more easily subject to dislodging and undesired repositioning that can change the specified decorative pattern of the paver pieces formed within the edging and staking Furthermore, where one or more of the integrated boundary ridge 122 and integrated stake 128 are included with the boundary grate substrate 106, where lateral forces are instant on the boundary grid substrate 106 those lateral forces are also opposed by the weight of the object (e.g., a car) moving on the paving system 100. As described above, where a car is driving on the paving system 100 including the upper paver service 132 shown in FIGS. 1A and 1B, a lateral force 136 is incident upon one or more of the plurality of paver pieces 104. The lateral force 136 incident on one or more of the plurality of paver pieces 104 is transmitted through the adjoining paver pieces 104 and the grid substrate 106 lying underneath the paver pieces 104. Because the weight of the object (e.g., a car) is transmitted through the paver pieces 104 to the boundary grid substrate 106, the lateral forces 136 are also opposed by the friction forces including the weight of the object as a component.

Moreover, where the paver system includes the paver linkage formed through engagement of the paver pieces 104 with the grid substrates 102 and boundary grid substrates 106 lateral forces 136 generated by the car through the paver pieces 104 overlying the grid substrate 102 are transmitted through the paver pieces 104 and distributed through the entire paver linkage 110 in addition to the integrated boundary ridge 122, the integrated stake 128 and the boundary grid substrate 106. Transmission of these forces across the paver linkage 110 distributes the lateral load throughout the linkage and ensures the lateral forces are opposed by the combined weight of the grid substrates 102, 106 the plurality of paver pieces 104, the weight of objects on the paver system 100 as well as the anchoring features including the integrated stake 128. Where pavers are otherwise arranged in a paving surface with isolated edging and staking along the periphery of the paving surface, lateral forces incident on the pavers are transmitted directly through the pavers to the edging and stakes. The edging and stakes are incapable of transmitting or distributing forces throughout the paving system and are thereby subject to the full lateral force of the tire rotation and are more likely to dislodge through repeated impacts from adjacent pavers into the edging and stakes.

FIG. 1C shows another example of a paver system 100 including a plurality of paver pieces 104 coupled over the paver surface 108 formed by the grid substrate 102 and a boundary grid substrate 106. The previous examples shown in FIGS. 1A and 1B showed paving systems 100 including one of the integrated boundary ridge 122 (see FIG. 1A) or the integrated stake 128 (FIG. 1B). FIG. 1C shows a boundary grid substrate 106 including the integrated stakes 128 and integrated boundary ridge 122 formed on a single boundary grid substrate 106. The integrated boundary ridge 122 provides a decorative feature extending around the upper paver surface 132 formed by the plurality of paver pieces 104. In addition, as described above, the integrated boundary ridge 122 provides a feature for engagement with the plurality of paver pieces 104 when the paver pieces are subjected to lateral forces. Because the integrated boundary ridge 122 is part of the boundary grid substrate 106 forces incident on the integrated boundary ridge 122 are transmitted through the boundary grid substrate 106. Further, where the grid substrate 106 is coupled with the grid substrate 102 by way of the paver linkage 110 lateral forces are transmitted through the paver linkage 110 and thereby distributed absorbed through the linked paver system 100 to ensure the paving system 100 including the plurality of paver pieces 104 are maintained in the desired orientation.

The integrated boundary stakes 128 (and the pierced ground) receive and absorb a portion of the lateral forces incident on the paver system 100. Because the stakes 128 are integral to the boundary grid substrate 106 some of the lateral forces are transmitted throughout the boundary grid substrate 106 and into the adjoining grid substrates 102 by way of the paver linkage 110. The integrated boundary ridge 122, integrated stake 128 and paver linkage 110 thereby cooperate to substantially prevent undesired motion of the plurality of paver pieces 104 out of the originally installed configuration. That is to say, as the paving system 100 experiences lateral forces over its lifetime the integrated boundary ridge 122, stake 128 as well as the paver linkage 110 substantially ensure the paver pieces 104 are maintained in the pattern as installed and dislodging of the paver pieces is substantially minimized.

Figure 2A:
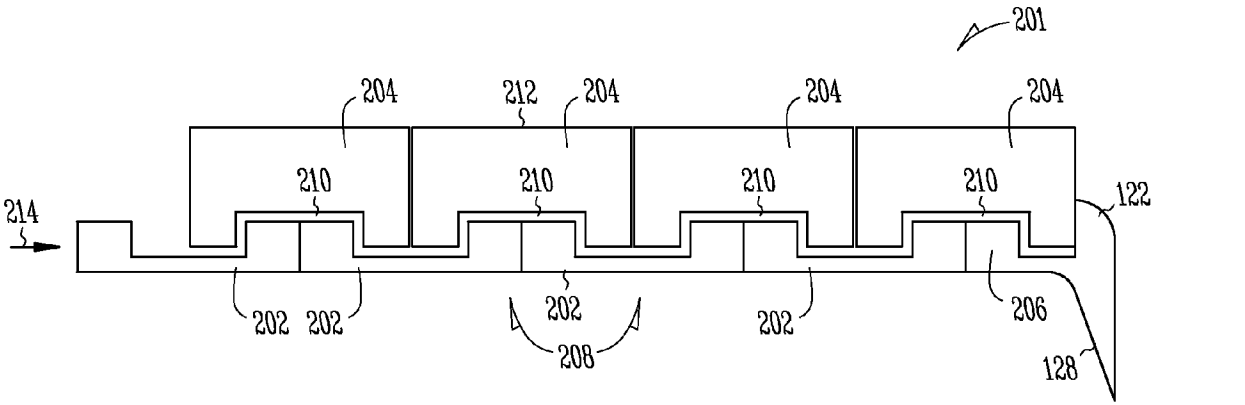
FIG. 2A is a side view of one example of a paving system including an articulated paver linkage formed with grid substrates and paver pieces, the articulated paver linkage is shown in an unexpanded state.
Figure 2B:
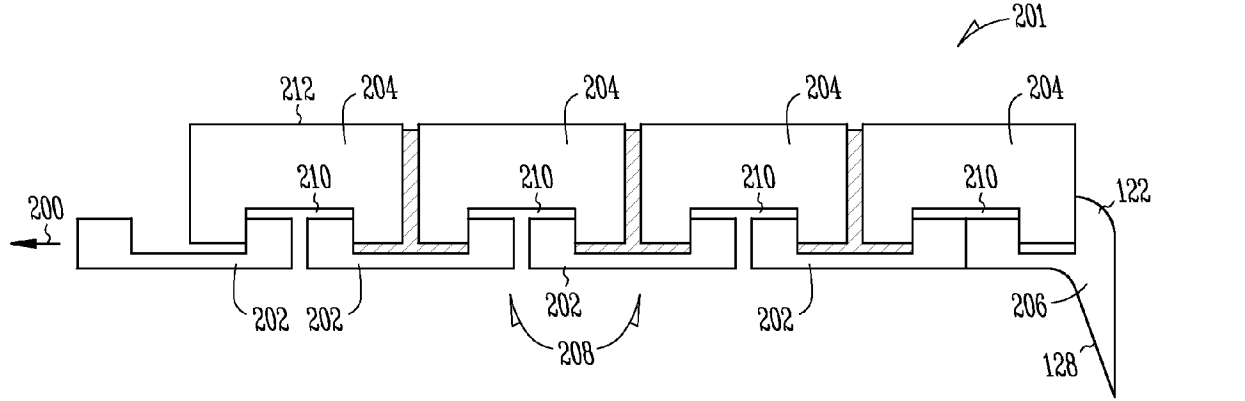
FIG. 2B is a side view of the paving system shown in FIG. 4B in an expanded state.

Referring now to FIGS. 2A and 2B, one example of a paving system 201 is shown in unexpanded and expanded configurations (FIGS. 2A, 2B, respectively). In one example, the paving system 201 is installed in the unexpanded configuration shown in FIG. 2A. For instance, the grid substrates 202 are positioned on an underlying surface including soil, sand or gravel and the boundary grid substrate 206 is positioned around at least a portion of the grid substrates 202. The paver pieces 204 are thereafter positioned over the grid substrates 202 and the boundary grid substrate 206 to form the upper paver surface 212.

As shown in FIG. 2A the paver pieces 204, grid substrates 202 and boundary grid substrate 206 are interlocked together at movable joints 210. The movable joints 210 form a paver linkage 208. As discussed previously, the paver linkage 208 cooperates with features including, for instance, the integrated boundary ridge 122 and the integrated stake 128, to transmit lateral forces incident against one or more of the stake and ridge 122 into the boundary grid substrate 206 as well as the grid substrates 202 and paver pieces 204. Distribution of these forces throughout the linkage 208 minimizes dislodging of the paver pieces 204, the boundary grid substrate 206 and the grid substrates 202. One example of the paving system 201 experiencing a lateral force 200 is shown in FIG. 2B. As shown in FIG. 2B, lateral force 200 is applied to the paving system 201 in a direction opposed to the boundary grid substrate 206. As the lateral force 200 is applied to the paver linkage 208, the force is transmitted through the paving linkage 208 and correspondingly through the interlocked grid substrates 202, 206 and paver pieces 204.

The lateral force 200 is thereby distributed throughout the paver linkage and only a portion of the lateral force 200 is received at the boundary grid substrate 206 including the integrated boundary ridge 122 and the integrated stake 128. Further, because the weight of the car is received on the upper paver surface 122, the weight of the car is applied to the paving system 201 thereby affirmatively anchoring the paving system 201 against lateral movement caused by the object overlying the paving system (e.g., a moving car). Further still, because the grid substrates 202 and boundary grid substrate 206 form a paving linkage 208 along with the paver pieces 204, lateral forces from the moving object are transmitted throughout the paver linkage and thereby opposed by the combined weight of the paving system (including the grid substrates and paver pieces forming part of the paver linkage) as well as the weight of the car. The lateral force from the vehicle such as the rotating tires is thereby opposed not only by the weight of a single paver piece but also the weight of the car itself on one or more paver pieces 204 and the weight of the paving system 201 (e.g., the grid substrates 202, 206 and paver pieces 204). Because of this distribution of forces the integrated stake 128 of the paving system 201 receives a fraction of the lateral force 200, and movement of the stake 128, the grid substrates 202, 206 and the paver pieces are minimized.

Referring again to 2A, another lateral force 214 is shown incident against a portion of the paving system 201. In this example the lateral force 214 is directed toward the boundary grid substrate 206. In a similar manner to the lateral force 200 shown in FIG. 2B, the lateral force 214 is distributed throughout the paver linkage 208 and is thereby opposed by the combined weight of the paving system (paver pieces, grid substrates, boundary grid substrates) and the weight of the vehicle or other features overlying the upper paver surface 212. Stated another way, any lateral forces 200, 214 applied to the paving system 201 in a direction toward or away from the boundary grid substrate 206 are opposed by a combination of the weight of the paver linkage 208, the weight of any overlying objects including the car that are positioned over the paver pieces 204 and grid substrates 202 forming the paver linkage 208 (and the corresponding friction forces) as well as the integrated boundary ridge 122 and integrated stake 128. The paver linkage 208 and the boundary grid substrate 206 including the integrated boundary ridge and integrated stake 122, 128 thereby distribute lateral forces throughout the paver linkage and minimize dislodging of the paver pieces 204 and the grid substrates from the paving system 201.

Figure 3A:
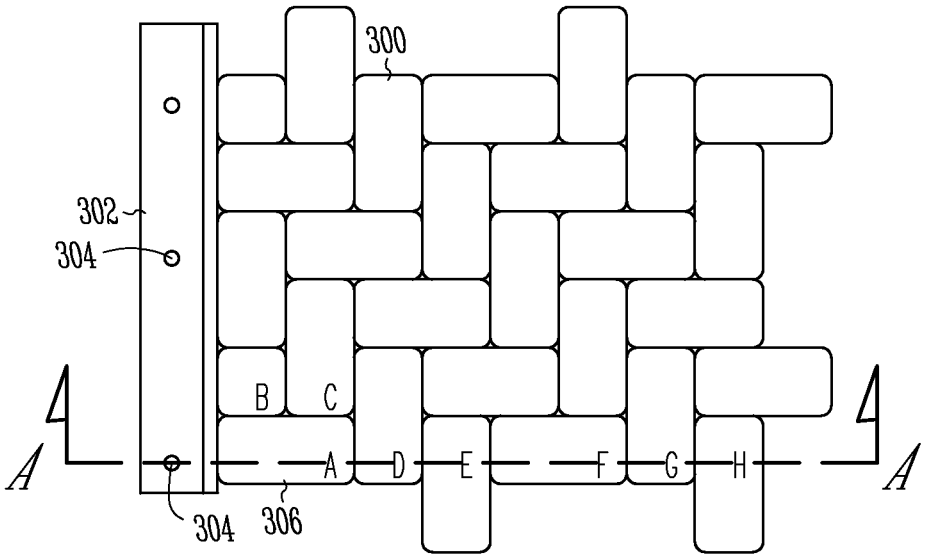
Fig. 3A (Prior Art)
FIG. 3A is a top view of a prior art arrangement of pavers with an isolated staked edging along a border of the arrangement.

FIG. 3A shows one example of a prior art paver surface including a series of pavers 306 positioned over an underlying surface, for instance a bed of sand or gravel. The paver surface 300 is bounded by edging 302 and stakes 304 staked through the edging 302. As shown in FIG. 3A, the paver surface 300 is immediately adjacent to the edging 302 and forces incident against the paver surface 300, for instance against the pavers 306, are transmitted directly to the edging 302 and stakes 304 without corresponding distribution of the forces through a paver linkage. Stated another way, the stakes 304 and edging 302 are not joined with any portion of the paver surface 300 other than by incidental contact and therefore any forces incident on the stakes 304 and edging 302 are entirely absorbed by the edging 302 and stakes 304.

Figure 3B:
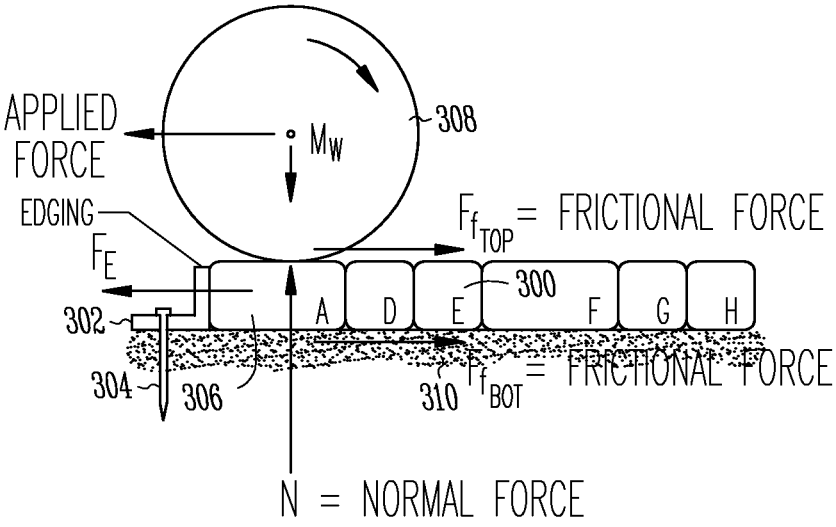
Fig. 3B (Prior Art)
FIG. 3B is a sectional view of the paver arrangement shown in FIG. 3A including a free body diagram of forces incident on an individual isolated paver according to rotational forces from a wheel.

FIG. 3B shows a cross-sectional view of the paver surface 300 shown in FIG. 3A. As shown, a wheel 308 is positioned above one of the pavers 306 and is rotating. The rotation of the wheel 308 provides a corresponding force to the paver immediately underlying the wheel 308. As shown in FIG. 3B, the rotation of the wheel 308 is transmitted through the paver 306 and results in a force against the edging $F_e$ that is incident against the edging 302 and stakes 304. The rotational force transmitted by the wheel 308 is only resisted by the friction $F_{flop}$ between the wheel and the paver 306 as well as the friction between the paver 306 and the underlying surface 310 ($F_{fbot}$). As shown in FIG. 3B, because the wheel 308 rests on a single paver 306, the paver 306 is subject to the entirety of the forces from the wheel as well as the friction forces. These forces are not otherwise distributed through the rest of the paver surface 300. Further, the forces incident on the paver 300 are transmitted through the paver to the stakes 304 and edging 302 immediately adjoining the paver 306.

To avoid dislodging of the paver 306 from the paver surface 300, stake 304 and edging 302 coupled with the stake must absorb virtually all of the applied force from the paver received from the wheel 308. With repeated loading of the edging 302 and stakes 304 over the lifetime of the paver surface 300, the edging and stake will gradually be pushed away from the remainder of the paver surface 300 and the pavers 306 will be able to dislodge from their installed orientation shown in FIG. 3A.

Figure 3C:
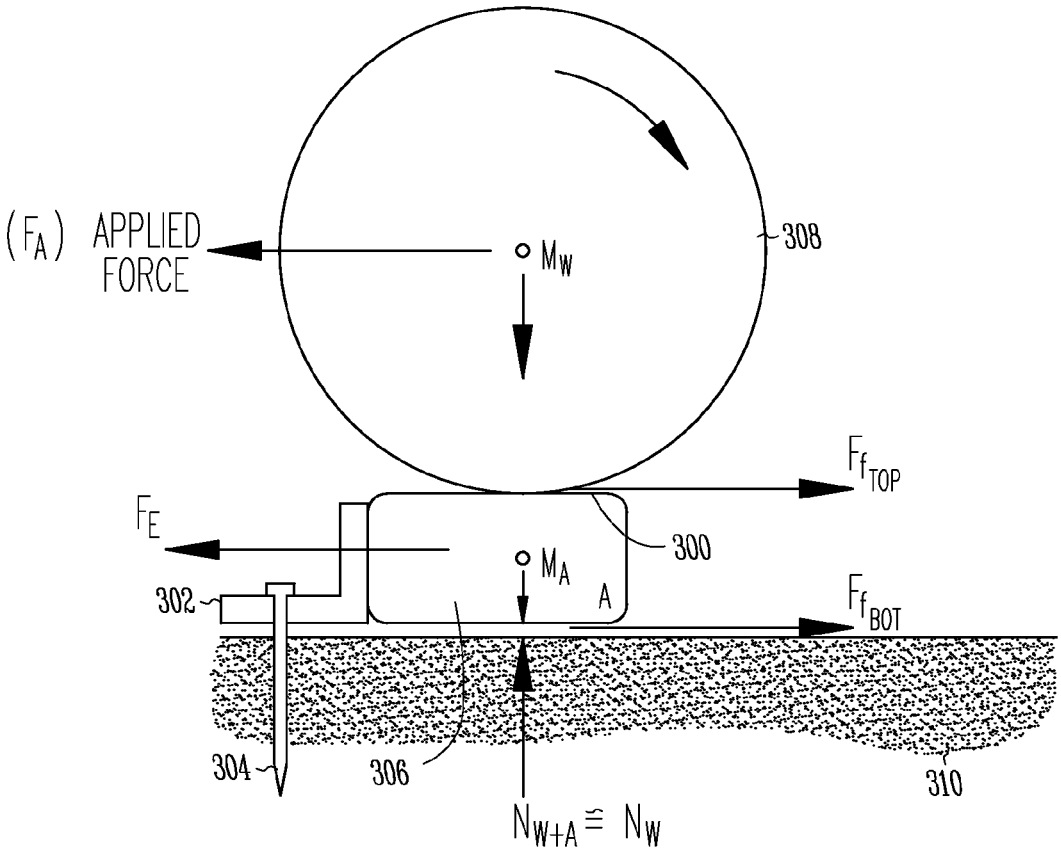
Fig. 3C (Prior Art)
FIG. 3C is a detailed sectional view of paver arrangement shown in FIG. 3A including a free body diagram of forces incident on an individual isolated paver and the separate edging and stake.

FIG. 3C shows a simplified view of the paver surface 300 including only the paver 306 immediately underlying the wheel 308. As previously described the paver 306 is separated from the remainder of the paver surface 300 because the paver 306 rests on an underlying surface 310 without the benefit of the paver linkage described previously. One example of the amount of force incident on the edging 302 and stake 304 ($F_e$) is determined according to the following example.

The mass of the wheel is determined to be one-quarter of the total weight of a regular car, for instance 1800 kilograms. The 1800 kilogram car accelerates away from the edging at maximum acceleration prior to tire spin. The equations described herein determine the horizontal loading at the staked edging 302 and stake 304 that must be absorbed to prevent movement of the paver 306 (e.g., dislodging). As discussed above, the vehicle is assumed to have a mass of approximately 1800 kilograms. Therefore, the wheel resting on the paver 306 is assumed to have 450 kilograms, in other words, one-quarter of the total car mass. Additionally, where the mass of the wheel is assumed to be approximately 450 kilograms, the mass of the paver is assumed to be a negligible amount relative to the mass of the wheel 308.

To determine the normal forces and thereby the frictional forces incident on the paver 306, the mass used in the normal force is assumed equivalent to the mass of the wheel (i.e., 450 kilograms). To further determine the frictional forces incident between the wheel 308 and the paver 306 a frictional coefficient of 0.8 is assumed. The coefficient of friction between the paver 306 and the underlying surface 310 is assumed to be 0.6, lower than that between the wheel 308 and paver 306 because the paver rests on a granular underlying surface (e.g., sand, gravel, soil and the like). The paver 306 will thereby slip over the underlying surface 310, for instance the sand bed, before the wheel 308 slips (e.g., spins) over the paver 306. It is because of this difference in the frictional forces that the edging 302 and stake 304 are separated from the paver surface 300 and must absorb the full amount of the incident force on the paver 300 to avoid dislodgement of the edging 302 and subsequent movement of the paver 306 away from the remainder of the paver surface 300.

In the example, the applied force from the wheel 308 to the paver 306 is equivalent to the friction force between the wheel 308 and paver 306 opposing the applied force. That is to say, because the assumption has been made that the paver 306 will slip on the underlying surface 310 prior to slippage between the wheel 308 and paver 306, the full applied force from the wheel 308 is transmitted to the paver 306. The applied force is therefore equal to the quantity of the coefficient of friction of the top of the paver 306 multiplied by the mass of the wheel (450 kilograms) times the acceleration of gravity (g=9.81 meters per second squared).

$$F_A = M_w \cdot a = \mu_{top} \cdot N_W = \mu_{top} \cdot M_W \cdot g$$

The quantity of the applied force is thereby equal to the coefficient of friction for the top of the paver 306 (0.8×450 kilograms×9.81 meters per second squared, or 3531.6 Newtons). The applied force $F_A$ determined above is opposed by the frictional forces between the paver 306 and the underlying surface 310, and the force transmitted to the edging $F_E$ is equal to the force applied to the paver 306 by the wheel 308 minus the frictional forces along the bottom of the paver 306. The relationship of the force on the edging ($F_E$) with the force applied to the paver 306 ($F_A$) and the frictional forces along the paver 306 and underlying surface 310 is shown in the relationship below.

$$F_E = F_A$$

$$= F_A - F_{fbot}$$

$$= 3531.6\ \text{N} - u_{bot} \times M_w$$

$$= 3531.6\ \text{N} - (0.6) \times (450\ \text{kg.}) \times (9.81\ \text{m/s}^2)$$

$$= 3531.6\ \text{N} - 2648.7\ \text{N}$$

$$F_E = 882.9\ \text{N}$$

As shown above, the force on the edging ($F_E$) that the edging 302 and stakes 304 must absorb to prevent dislodging of the paver 306 from the paver surface 300 is equal to 882.9 N where the mass of the vehicle is assumed to be 1800 kgs. As previously described, the remainder of the paver surface 300, for instance shown in FIG. 3A, is unable to absorb any of the forces on the paver 306 adjacent to the edging 302 and stake 304.

Over time and with continued loading of the pavers 306 adjacent to the edging 302 and stakes 304, the edging and stakes will gradually become dislodged by continued force loading. The adjacent pavers 306 will begin to dislodge and move away from the remainder of the paver surface 300. As those outlying pavers 306 move away from the paver surface 300, pavers 306 closer to the interior of the paver surface 300 will also begin to move away from the remainder of the paver surface as the outlying pavers 306 are no longer present to brace the inner pavers against moving. The pavers 306 will thereby gradually begin to dislodge from the remainder of the paver surface 300. Time consuming and expensive labor is needed to tap the pavers 306 back into position, replace missing pavers and then re-stake down the edging 302 along the perimeter of the paver surface 300.

Figure 4:
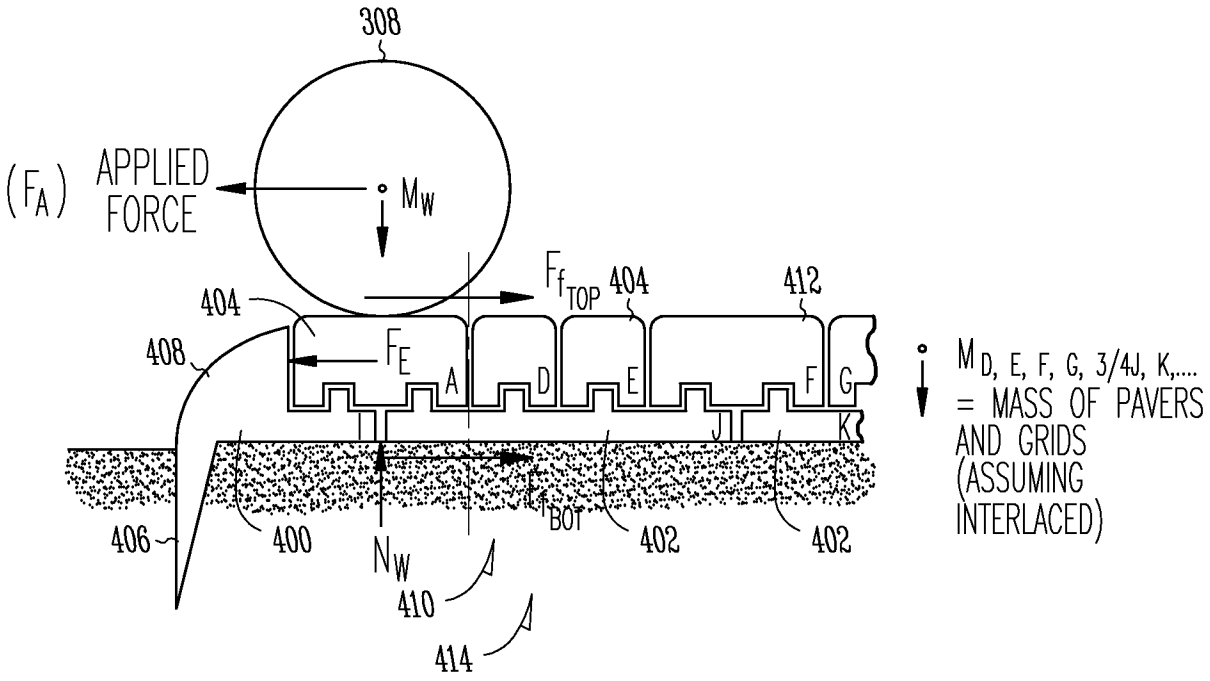
FIG. 4 is a side view showing one example of a bounded paving system including an integrated boundary ridge and stake as part of a paver linkage with grid substrates and paver pieces and includes a free body diagram showing forces distributed through the linkage.

FIG. 4 shows another schematic example of the wheel 308 positioned on a paver surface 412 including a plurality of paver pieces 404 coupled over grid substrates 402 and a boundary grid substrate 400. As shown in FIG. 4 the plurality of paver pieces 404, grid substrates 402 and boundary grid substrate 400 form a paver linkage 410 because the pavers 404 are interlocked with the grid substrates 400, 402. As described above, the paver linkage 412 transmits and distributes forces incident on a subset of paver pieces 404 throughout the paver linkage 410 thereby anchoring the paver pieces 404 in place on the paver surface 412. The paver pieces 404 are maintained in the installed configuration over the lifetime of the paver surface 412. In the example found immediately below, in contrast to the example shown in FIGS. 3A-3C, the applied force ($F_A$) applied by the wheel 308 to the paver surface 412 is successfully opposed by the combined weight and friction forces of the paver linkage 410 and the overlying object (e.g., a car). Stated another way, the applied force is distributed throughout the paver linkage and substantially minimizes forces applied to the boundary grid substrate 400 to a negligible amount. The paver surface 412 is thereby maintained in the desired configuration without dislodging of the paver pieces 404 or dislodging of the boundary grid substrate 400 including the integrated boundary ridge 408 and integrated stake 406.

The example shown in FIG. 4 uses similar assumptions to the previous example. The mass of the wheel is 450 kg and the coefficients of friction between the wheel and the paver pieces 404 and the grid substrates 400, 402 and the underlying surface are $\mu_{top}$=0.8 and $\mu_{bot}$=0.6. The force on the boundary grid substrate 400 ($F_E$), is equal to the applied force on the adjacent paver 404 ($F_A$) minus the friction along the bottom of the paver linkage 410 ($F_{fbot}$). Stated another way, the friction along the bottom of the paver linkage 410 opposes the applied force between the wheel 308 and the paver surface 412 and thereby minimizes the amount of force incident ($F_E$) on the boundary grid substrate 400.

$$F_E=F_A-F_{fbot}$$

As previously discussed above, the mass of the paver 306 shown in FIGS. 3B and 3C immediately underlying the wheel 308, was considered to be negligible relative to the mass of the wheel 308 (450 kg). In the example shown in FIG. 4 the mass of the paver piece 404 immediately underlying the wheel 308 may be negligible. That cannot be said for the entirety of the paver linkage 410 underlying the wheel 308. Because each of the components of the paver linkage 410 is interlocked, the weight of the system underlying the wheel is equivalent to the mass of the underlying paver A as well as the pavers D, E, F and G and the grid substrates 400, 402 (grid substrates I, J and K). Because the paver linkage 410 is distributed over an area and each of the components of the paver linkage are interconnected as described above, the force of friction along the bottom of the paver linkage 410 is much larger than the frictional forces along the bottom of the single paver 306 shown in FIGS. 3B and 3C.

$$F_E=F_A-F_{fbot}$$

$$=3531.6\text{ N}-F_{fbot}$$

$$=3531.6\text{ N}-\mu_{bot}*N_{total}\ [\text{Where } N_{total}=N_w+M_{a,d,e,f,g,i,j,k}*g]$$

$$F_E=3531.6\text{ N}-0.6*(450\text{ kg}+M_{a,d,e\ldots})*(9.81\text{ meters per second squared}).$$

Where it is desired for the force on the edging ($F_E$) to be negligible, approximately 0 Newtons, and the boundary grid substrate 400 experiences negligible forces and thereby is not subject to dislodging by the applied force from the wheel 308, the mass of the paver linkage 410 ($M_{a,d,e}$, . . . ) must be greater than 150 kilograms. If the paver linkage 410 in its entirety has a mass greater than 150 kilograms, then the corresponding frictional forces along the bottom of the paver linkage 410 are great enough to oppose the applied force from the wheel 308 to the paver surface 412. The paver linkage thereby fully absorbs the applied force to the paver surface 412 without transmission of the applied force to the boundary grid substrate 400 and the associated integrated boundary ridge 408 and integrated stake 406. Stated another way, by distributing the applied force form the wheel 308 across the entirety of the paver linkage 410, the paver linkage 410 is able to absorb the applied forces and anchor the paver surface 412 in place without applying forces to the integrated boundary ridge 408 and integrated stake 406 that could dislodge the boundary grid substrate 400 and subsequently dislodge the paver pieces 404. The boundary grid substrate 400 with the integrated boundary ridge 408 and integrated stake 406 provides additional reinforcement against any remaining forces applied from the wheel 308 that are otherwise transmitted to the integrated boundary ridge 408. That is to say, if the paver linkage 410 is unable to fully absorb all of the applied forces from the wheel 308, the boundary grid substrate (including the integrated boundary ridge and integrated stake) absorb the remaining force and thereby maintain the paver surface 412 over the working lifetime in a configuration provided at installation.

Because the paver system 414, including the paver linkage 410 is able to maintain the paver pieces 404, and both the underlying grid substrates 400, 402 in the installed configurations throughout the lifetime of the paver surface 412, time consuming maintenance and replacement materials are thereby avoided. Further, the paver linkage 410 along with the boundary grid substrate 400 including the integrated stake 406 and integrated boundary ridge 408 maintain the decorative and aesthetic configuration of the paver pieces 404 over the lifetime of the paver system 414.

Figure 5A:
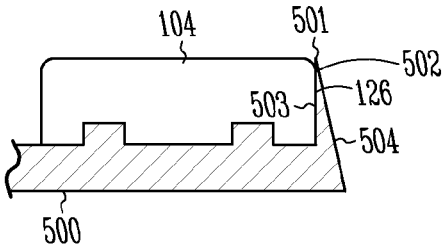
FIG. 5A is a side view showing one example of a grid substrate including a flat angled boundary ridge.
Figure 5B:
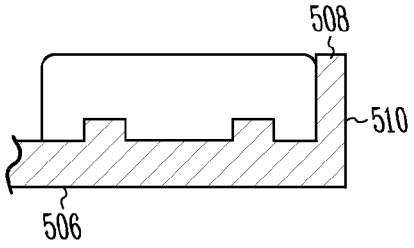
FIG. 5B is a side view showing another example of a grid substrate including a flat vertical boundary ridge.

FIGS. 5A through 5F show a variety of boundary grid substrates including differing integrated boundary ridges having decorative surfaces. Although a number of different decorative boundary ridge configurations are shown in FIGS. 5A through 5F it will be understood that additional decorative boundary ridge configurations are available and covered by the equivalents to these integrated boundary ridges shown herein. FIG. 5A shows one example of a boundary grid substrate 500 including an integrated boundary ridge 502. A paver piece 104 is positioned adjacent to the integrated boundary ridge 502. The integrated boundary ridge 502 shown in FIG. 5A tapers from a boundary ridge upper edge 501 toward the bottom surface of the boundary grid substrate 500. The exterior face 504 includes an angle relative to the vertical angles of the interior face 503 of the integrated boundary ridge 502. In contrast, FIG. 5B shows another example of a boundary grid substrate 506 including an integrated boundary ridge 508 having a flat vertical exterior face 510.

Figure 5C:
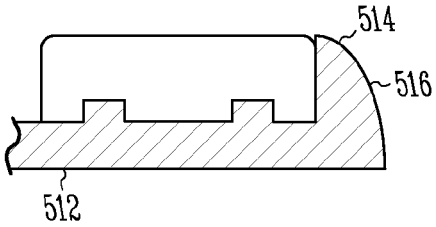
FIG. 5C is a side view showing yet another example of a grid substrate including a concave bull nose boundary ridge.
Figure 5D:
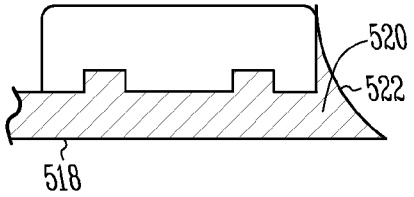
FIG. 5D is a side view showing still another example of a grid substrate including a convex bull nose boundary ridge.

FIGS. 5C and 5D show two more examples of boundary grid substrates 512, 518 including bull nose configured boundary ridges 514, 520. As previously described above, the integrated boundary ridges 514, 520 are formed as a part of the boundary grid substrate 512. Referring to FIG. 5C the exterior face 516 of the boundary grid substrate 512 includes a concave bull nose configuration. In the example shown in FIG. 5D, the exterior face 522 of the boundary grid substrate 518 includes a convex bull nose configuration. The boundary grid substrates are formed with a process including, but limited to, extrusion, pultrusion and the like. The various configurations of the exterior faces provide a variety of decorative external appearances to the boundary grid substrates and add to the overall decorative and aesthetic appearance of the paver surfaces formed by the plurality of the paver pieces 104, the boundary grid substrates and grid substrates forming the paver linkage and paver system.

Figure 5E:
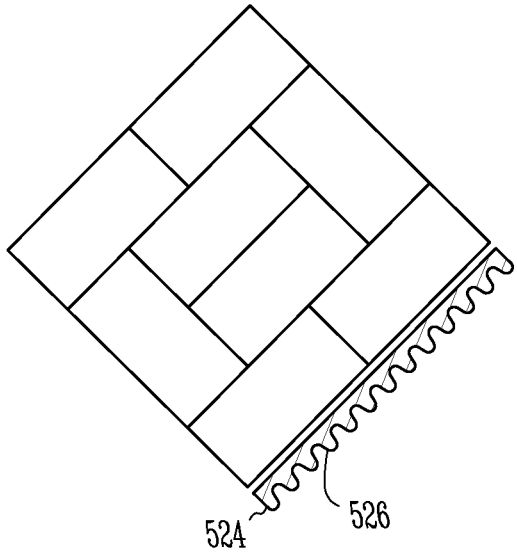
FIG. 5E is a top view showing an additional example of a grid substrate including a ribbed surface.
Figure 5F:
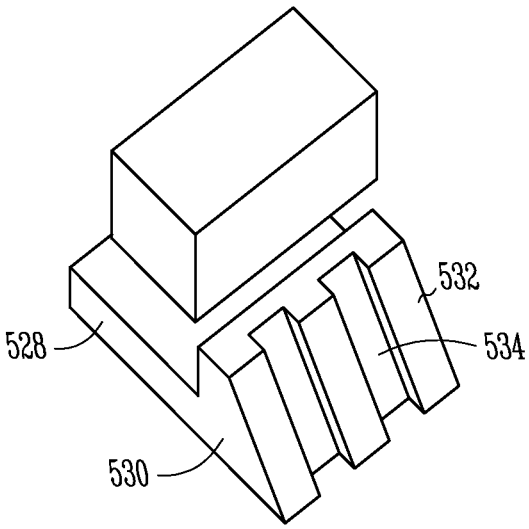
FIG. 5F is a side view showing a supplemental example of a grid substrate including an angled ribbed surface.

Referring now to FIG. 5E another example of a boundary grid substrate is shown including an integrated boundary ridge 524 having a corrugated or ribbed surface 526. In the example shown in FIG. 5E the exterior face 526 has a corrugated surface includes a rounded ribbed configuration. In contrast, the boundary grid substrate 528 shown in FIG. 5F includes an integrated boundary ridge 530 having an exterior face 532 including decorative ridges and recess 534. The exterior face 526 shown in FIG. 5E differs from the corrugated or ribbed surface of the exterior face 534 in that the exterior face 526 includes a rounded ribbed configuration while the exterior face 532 including the ridge surface 534 has a faceted decorative appearance. Additionally, the integrated boundary ridge 530 of the boundary grid substrate 528 includes an angled exterior face 532 angled relative to, for example, the vertical surfaces of the paver piece 104. In the example shown in FIGS. 5E and 5F, the boundary grid substrates including the integrated boundary ridges 524, 530 are formed by molding, machining and the like. In another example, the boundary grid substrates are formed by extrusion and the corrugated exterior faces 526, 532 are formed after extrusion or protrusion, for instance, by machining and other processes.

Figure 6A:
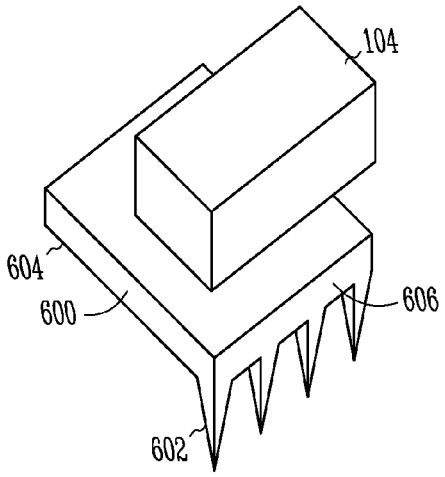
FIG. 6A is a perspective view showing one example of a grid substrate including an integrated stake.
Figure 6B:
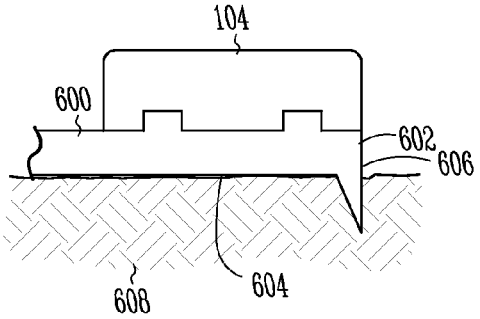
FIG. 6B is a cross sectional view of the grid substrate of FIG. 6A with the integrated stakes anchored in a subgrade with the grid substrate positioned over an underlying surface of the subgrade.

Referring now to FIGS. 6A and 6B, another example of a boundary grid substrate 600 is shown including an integrated stake 602 extending from a lower surface 604 of the substrate. Referring to FIG. 6A, in the example shown multiple integrated stakes 602 extend from the lower surface 604 of the boundary grid substrate 600. FIG. 6B shows the boundary grid substrate 600 shown in FIG. 6A in an installed configuration where the paver piece 104 is coupled along the boundary grid substrate 600 and the integrated stakes 602 are pierced through an underlying surface 608 (e.g., sand, soil, gravel, and the like). The lower surface 604 of the boundary grid substrate 600 is resting on the remainder of the underlying surface 608.

As shown in FIGS. 6A and 6B, the integrated stakes 602 is positioned along a boundary grid substrate edge 606. In another example, the integrated stake 602 is positioned anywhere along the lower surface 604 of the boundary grid substrate 600. That is to say, that the integrated stakes 602 of the boundary grid substrate are positioned along the lower surface 604 of the boundary grid substrate in one or more patterns and locations distributed across the lower surface 604 of the boundary grid substrate. Importantly, the integrated stakes 602 provide the same anchoring function to the boundary grid substrate 600 and the paver linkages described here in (e.g., the paver pieces and other grid substrates) when positioned along the lower surface 604. Stated another way, the integrated stake 602 cooperates with the distribution of forces through the paver linkage to absorb at least some of the forces incident on the paver linkage without allowing dislodging of the paver pieces 104, grid substrates or the boundary grid substrate from the paver system.

Figure 6C:
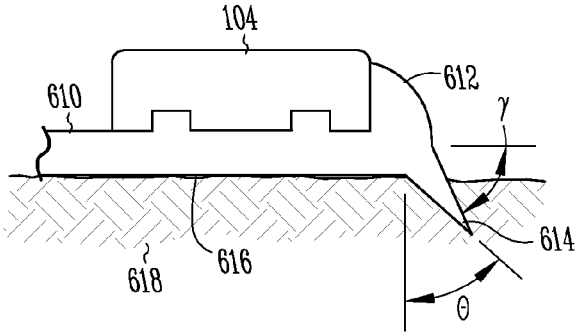
FIG. 6C is a cross sectional view of another example of a grid substrate with an integrated stake at an angle relative to a vertical axis.

FIG. 6C shows another example of a boundary grid substrate 610 including an integrated boundary ridge 612 and an integrated stake 614. A paver piece 104 is shown positioned on the boundary grid substrate 610 and the boundary grid substrate 610 is shown positioned on an underlying surface 618. In the example shown in FIG. 6C the integrated stake 614 extends away from the remainder of the boundary grid substrate 610 at an angle, for instance, an angle $\theta$ relative to vertical and an angle $\gamma$ relative to the horizontal. Providing the integrated stake 614 at an angle relative to the remainder of the boundary grid substrate 610 drives the integrated stake 614 into tighter engagement with the underlying surface with application of a lateral force through the boundary grid substrate toward the integrated stake 614. Lateral forces in the direction of the integrated stake 614 tightly and affirmatively engage the boundary grid substrate 610 with the underlying surface 618. Stated another way, lateral forces incident to the paver piece 104 in the direction of the integrated stake 614 drive the integrated stake further into the underlying surface 618 because of its angled relationship to horizontal and vertical as shown in FIG. 6*c*.

Figure 7:
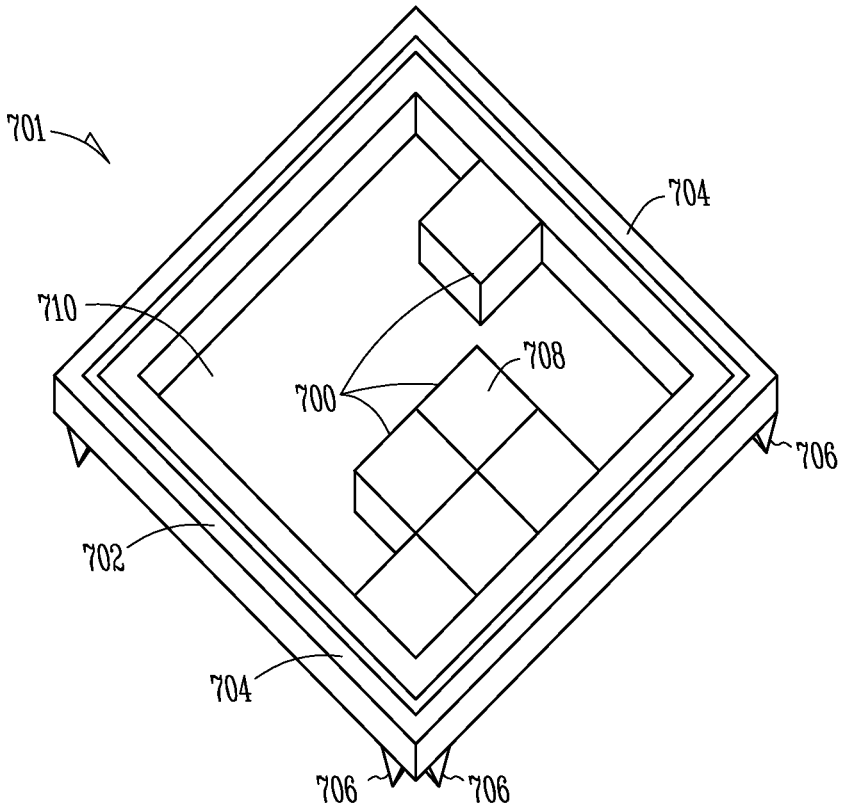
FIG. 7 is a perspective view of one example of a boundary ridge grid substrate including integrated stakes and an integrated boundary ridge.

FIG. 7 shows another example of a boundary grade substrate 702 extending around a boundary grid orifice 710. As shown in FIG. 7, the boundary grid substrate 702 is a continuous or near continuous loop extending around the orifice 710. In another example, the boundary grid substrate 702 is composed of two or more boundary grid substrates fit together to form a perimeter around the boundary grid orifice 710. As in previous examples, the boundary grid substrate 702 includes an integrated boundary ridge 704 extending around the perimeter of the boundary grid substrate and integrated stake 706 for at least a portion of the underlying surface of the boundary grid substrate.

The boundary grid substrate 702 forms a portion of a paver system 701 including grid substrates 700 positioned in a specified pattern within the boundary grid orifice 710. As shown in FIG. 7, the grid substrates 700 are arranged in a regular pattern to fill the boundary grid orifice 710 and thereby form a paver support surface 708 including both of the upper surfaces of grid substrates 700 and boundary grid substrate 702. As in previous examples, pavers such as pavers 104 shown in FIGS. 1A through 1C are positioned over the paver surface 708 to form the upper paving surface of the paver system 701. The boundary grid substrate 702 and grid substrate 700 are interlocked with the paving pieces 104 to form a paving linkage to distribute lateral forces throughout the paver system 701 and maintain the grid substrates 700, the boundary grid substrate 702 and paving pieces 104 in the specified orientation arranged at installation of the paving system 701.

A boundary grid substrate 702 forms a continuous or near continuous perimeter around the grid substrate 700. For instance, where the boundary grid substrate 702 is a unitary body it defines a continuous perimeter that the grid substrates 700 fit within. Additionally the unitary perimeter of the boundary grid substrate 702 provides another feature to receive and absorb lateral forces on the pavers 104 and distribute those forces throughout the paving system 701. Stated another way, the boundary grid substrate 702 frames the paving system 701 and maintains the grid substrate 700 and paving pieces 104 coupled over the paver support surface 708 in the desired configuration. In other examples, the boundary grid substrate 702 has a different shape, for instance, an angular shape, ovular shape, circular shape, rectangular shape and the like. The variety of sizes and shapes permit the installer to assemble a variety of differently shaped boundary grid substrates 702 into a composite paving surface where grid substrates 700 are positioned within the perimeters of each of the boundary grid substrates 702 and the paving pieces 104 are positioned thereover to form a composite paving system for use with irregularly shaped driveways, street surfaces, courtyards, sidewalks and the like.

Figure 8:
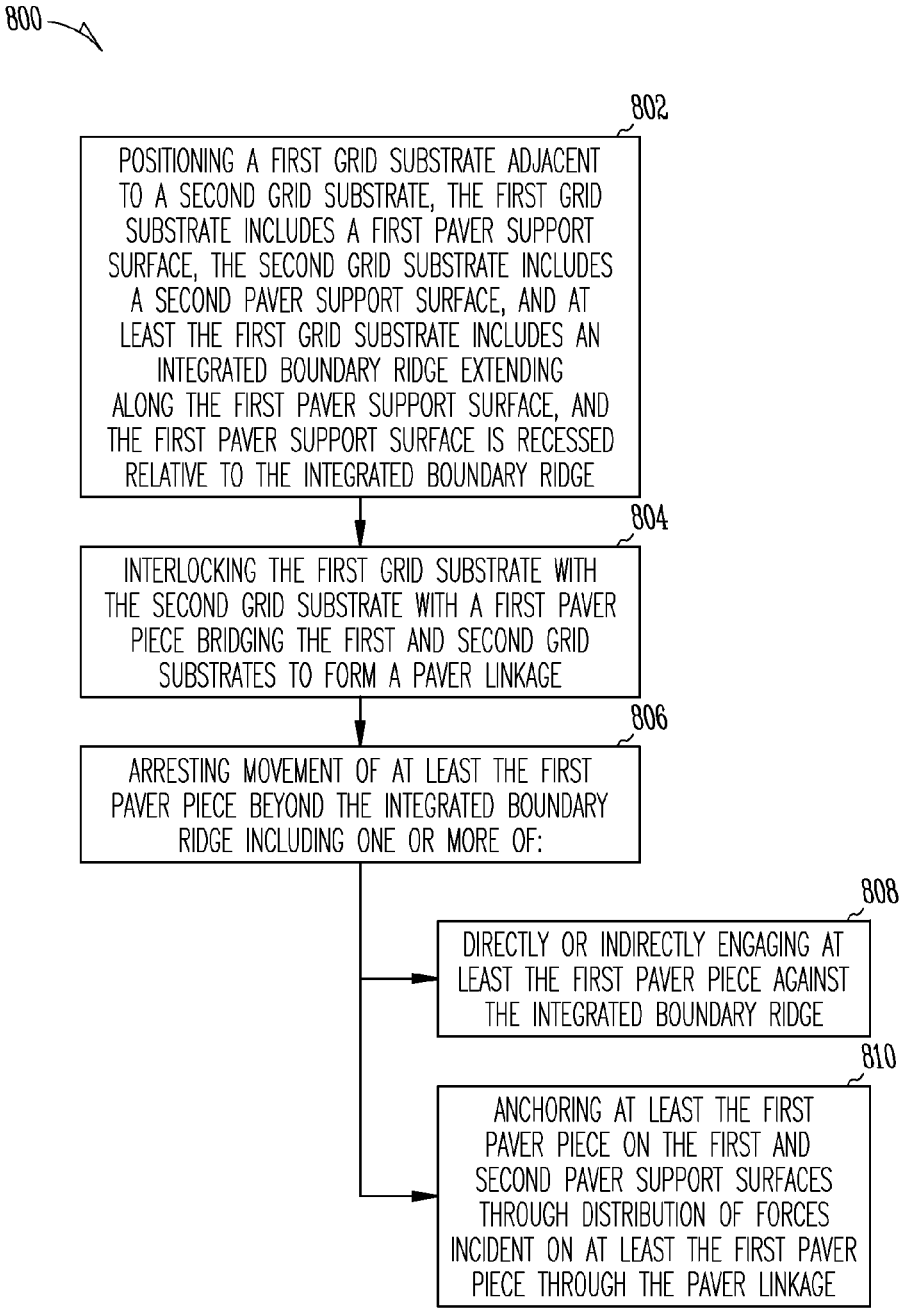
FIG. 8 is a block diagram showing one example of a method for installing a paver system including arresting movement of paver pieces with a boundary ridge.

Referring now to FIG. 8, one example of a method 800 for installing a paver system, such as paver system 100 (shown in FIG. 1A), is provided. Reference is made in the description of method 800 to elements and features provided herein. Where helpful reference is made to numbered components in the Figures. Reference to a particular number is not intended to be limiting and the discussed element or feature is intended to include any of the examples described herein as well their equivalents. At 802, a first grid substrate, such as boundary grid substrate 106 is positioned adjacent to a second grid substrate 102. The first grid substrate 102 includes a first paver support surface such as paver surface 108 shown in FIG. 1A. The boundary grid substrate 106 includes a second paver support surface including a paver support surface that is continuous with paver support surface 108 shown on the grid substrate 102. At least the boundary grid substrate 106 includes an integrated boundary ridge 122 extending along the paver support surface 108. The first paver support surface 108 is recessed relative to the integrated boundary ridge 122.

At 804, the boundary grid substrate (e.g., first grid substrate) 106 is interlocked with the second grid substrate 102 with a first paver piece 104 bridging the first and second grid substrates 102, 106 to form a paver linkage, such as paver linkage 110 shown in FIG. 1A. In one example, interlocking the first and second grid substrates 102, 106 includes inserting at least one of paver projections 118 or grid projections 114 into corresponding grid recesses 116 and paver recesses 120. Optionally, interlocking of the first and second grid substrates 102, 106 includes movably coupling the first paver piece 104 with the first and second paver support surfaces 108 to form an articulated paver linkage capable of relative rotation, expansion and compression between the paver piece 104 and grid substrates 102, 106. One example of a movable joint is shown as element 112 in FIGS. 1A, 1B, and 1C and includes an amount of tolerance between the recesses and projections to allow rotation and translation between the paver piece 104 and the grid substrates 102, 106.

At 806, the method 800 includes arresting movement of at least the first paver piece beyond the integrated boundary ridge 122 of the boundary grid substrate 106. Arresting movement includes one or more of the following elements 808, 810. At 808, at least the first paver piece 104 is directly or indirectly engaged against the integrated boundary ridge 122. For instance, where the paver piece 104 is bridging across the boundary grid substrate 106 and grid substrate 102 a second paver piece 104 is interposed between the first paver piece 104 and the integrated boundary ridge 122. Forces incident on the bridging paver piece 104 are transmitted to the adjacent paver piece and thereafter transmitted into the integrated boundary ridge 122.

At 810, arresting movement of at least the first paver piece 104 includes in another option anchoring at least the first paver piece 104 and the first and second paver support surfaces 108 (of the grid substrates 102, 106) through distribution of forces incident on at least the first paver piece 104 through the paver linkage 110. Stated another way, because the first paver piece 104 forms a portion of the paver linkage 110 including the interlocked grid substrates 102, 106 (and other grid substrates coupled into the paver linkage as well as the associated paver pieces) forces incident on the paver piece are distributed throughout the linkage. Incident forces must thereby overcome the added weight of each of the additional paver pieces 104 and grid substrates 102, 106 to move the paver piece 104 from its interlocked position with the grid substrates 102, 106.

In another example, the method 800 includes coupling a second paver piece 104 with the first grid substrate (e.g., the boundary grid substrate 106) and includes interposing the second paver piece 104 between the integrated boundary ridge 122 and the first paver piece 104 that bridges between the first and second grid substrates 102, 106. With this arrangement arresting movement of at least the first paver piece 104 also includes arresting movement of the second paver piece 104 including one or more optional steps described below. In one option, arresting movement of at least the first paver piece and second paver piece includes engaging the second paver piece against the integrated boundary ridge and indirectly engaging the first paver piece 104 with the integrated boundary ridge 122. Stated another way, the first paver piece 104 is engaged directly with the second piece 104 (e.g., paver piece positioned adjacent to the integrated boundary ridge) and the second paver piece is thereby directly engaged with the integrated boundary ridge. Forces are transmitted indirectly from the first paver piece 104 into the second paver piece and from the second paver piece to the boundary grid substrate 106 formed with the integrated boundary ridge 122. In another option, the first and second paver pieces are anchored on the first and second paver support surfaces 108 of the corresponding grid substrate 102, 106. The first and second paver pieces 104 are anchored through distribution of forces incident on at least one of the first or second paver pieces 104 through the paver linkage 110 included for instance all of the associated grid substrates 102, 106 (including grid substrates not shown) and the paver pieces 104 overlying the grid substrates. As stated above, forces incident on one or more of the plurality of paver pieces 104 must overcome the combined weight of the paver pieces as well as the grid substrates of the paver linkage 110 in order to move one or more of the paver pieces 104 out of its installed position at installation.

Several options for the method 800 follow. In the examples described above, one or more paver pieces 104 are described relative to their interactions with one or two grid substrates 102, 106. In one example, arresting movement of the paver piece 104 as described at step 806 and in other options includes arresting the movement of a plurality of paver pieces, for instance, three or more paver pieces directly engaged and indirectly engaged with the integrated boundary ridge 122 through engagement with interposed paver pieces 104 of the plurality of paver pieces. Stated another way, where the paving system 100 includes a series of grid substrates 102 and boundary grid substrates 106 a corresponding plurality of paver pieces 104 are positioned over the paver support surface 108 of the grid substrates. The plurality of paver pieces present in the paving system 100 that are not otherwise immediately adjacent to the boundary ridge 122 are otherwise indirectly engaged with the boundary ridge through paver pieces 104 interposed with those plurality of paver pieces in the boundary ridge 122.

In another example, anchoring the first and second paver pieces 104 on the first and second paver support surfaces 108 includes fixing the first and second grid substrates 102, 106 in place over an underlying surface (e.g., soil, sand, gravel and the like) according to a combined weight of the first and second grid substrates 102, 106 and the first and second paver pieces 104 along with any corresponding friction forces arising from the combined weight of those components. In still another example, the method 800 includes staking the first grid substrate 106 on an underlying surface such as soil, gravel, sand and the like. In still another example, staking the first grid substrate 106 includes piercing an integrated stake such as the integrated stake 128 shown in FIG. 1B through the underlying surface.

In yet another example, the second paver piece 104 is positioned adjacent to the integrated boundary ridge 122 and an upper paver surface 132 of the second paver piece 104 is substantially flush with the boundary ridge upper edge (e.g., integrated boundary ridge edge 501 shown in FIG. 5A). In still other examples, the integrated boundary ridge edge 501 is positioned above the upper paver surface 132. In another option, the integrated boundary ridge edge 501 is positioned below the upper paver surface 132 of the plurality of paver pieces 104.

Figure 9:
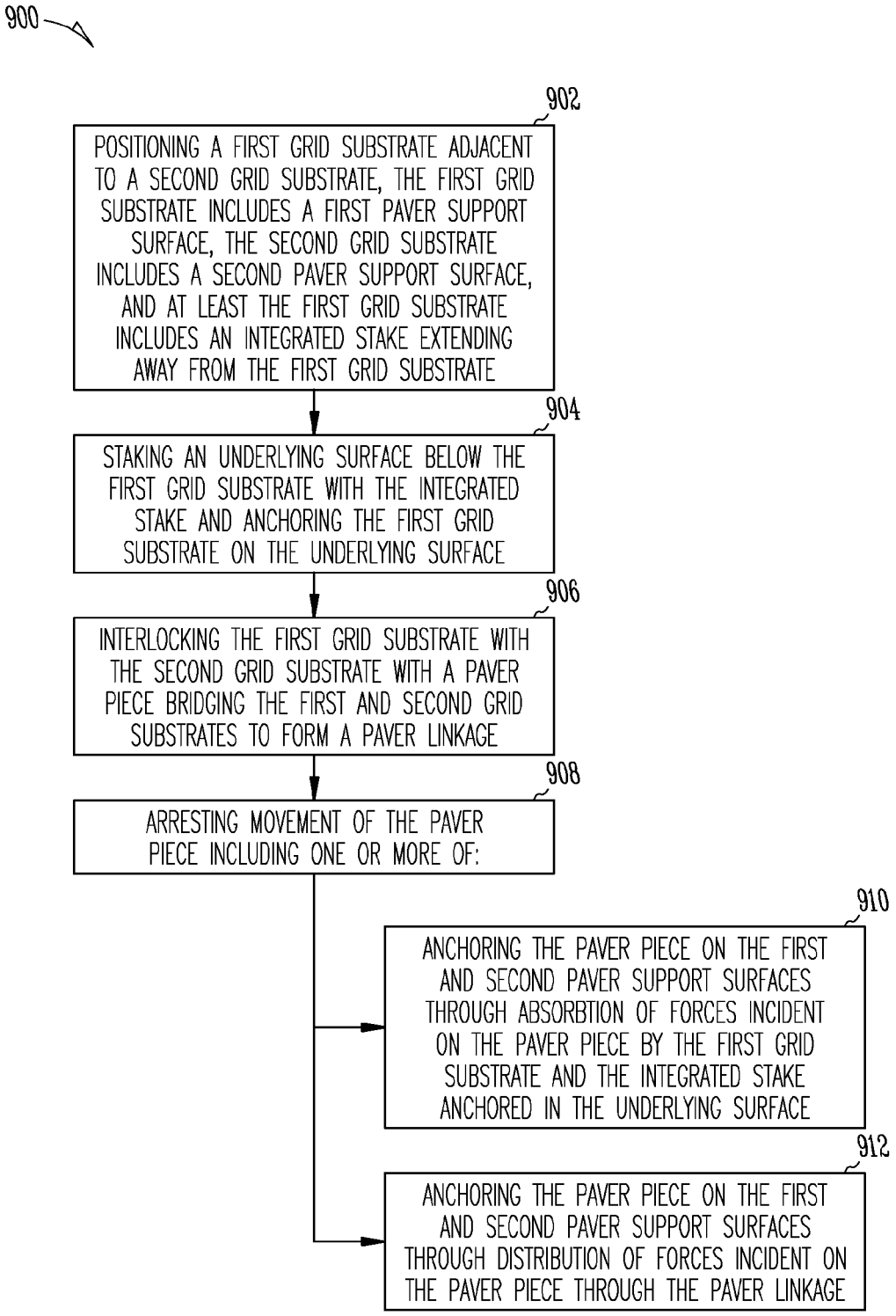
FIG. 9 is a block diagram showing one example of a method for installing a paver system including arresting movement of paver pieces with a grid substrate including an integrated stake.

FIG. 9 shows another example for installing a paver system such as paver system 100 shown in FIGS. 1B and 1C. As discussed above with regard to method 900, reference is made to features and functions present in one or more of the examples described herein. Where reference is made and includes an element number previously described the element number is not limiting but also includes other corresponding elements and features within the specification as well as their equivalents. At 902, a first grid substrate 106 is positioned adjacent to a second grid substrate 102. The first grid substrate 106 includes a first paver support surface 108 and the second grid substrate includes a corresponding paver support surface 108 that forms a composite paver surface extending across the grid substrates 102, 106. At least the first grid substrate 106 includes an integrated stake 128 extending away from the first grid substrate 106. At 904, the method 900 includes staking an underlying surface such as soil, gravel, sand and the like below the first grid substrate 106 with the integrated stake 128. Staking of the underlying surface anchors the first grid substrate 106 on the underlying surface.

At 906, the first and second grid substrates 106, 102 are interlocked with one or more paver pieces 104 bridging the first and second grid substrates to form a paver linkage 110. As previously described in other examples above, the plurality of paver pieces 104, in one example, include recesses sized and shaped to receive corresponding projections from the grid substrates. In another example, the grid substrates include recesses sized and shaped to receive projections from the plurality of paver pieces 104. The paver linkage 110 allows for the transmission of lateral forces from the paver pieces 104 throughout the paver linkage 110 where the paver linkage includes the composite weight of the assembled and interlocked paver pieces 104 and grid substrates 102, 106.

At 908, the method 900 includes arresting movement of the paver piece 104 including one or more of the following options. In one option, at 910, the paver piece 104 is anchored on the first and second paver support surfaces 108 of the grid substrate 102, 106 through absorption of forces incident on the paver piece 104 by the first grid substrate 106 and the integrated stake 128 anchored in the underlying surface (e.g., the sand, soil, gravel and the like). Stated another way, lateral forces are applied to the paver piece 104 including paver pieces positioned on the grid substrates 102 or 106, and the lateral forces are transmitted through the linkage 110 to the integrated stake 128 and absorbed through the anchoring of the integrated stakes in the underlying surface. In still another option, arresting the movement of the paver piece 104 includes anchoring the paver piece 104 on the first and second paver support surface 108 through distribution of the forces incident on the paver piece through the paver linkage 110. As described above, where the paver piece 104 forms a portion of the paver linkage 110 forces incident on the paver piece are necessarily opposed by the combined weight of the paver piece as well as the plurality of paver pieces 104 coupled with the paver linkage 110 as well as the grid substrates 102, 106. Forces incident on the paver piece 104 thereby must not only move the paver piece 104 but must also move the interlocked grid substrates 102, 106 and additional paver pieces 104 to dislodge the paver piece. The additional paver pieces 104 and grid substrates 102, 106 thereby serve to anchor the paver piece 104 against undesired movement of the paver piece from an installed orientation.

Although the present invention has been described in reference to preferred embodiments, persons skilled in the art will recognize that changes may be made in form and detail without departing from the spirit and scope of the invention.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A paving system comprising:

a plurality of grid substrates configured for arrangement along a surface, wherein each of the grid substrates of the plurality of grid substrates includes a paver support surface;

at least one boundary ridge grid substrate configured for arrangement along the surface, the at least one boundary ridge grid substrate includes:

a boundary ridge paver support surface, and an integrated boundary ridge above the boundary ridge paver support surface; and a plurality of paver pieces configured for coupling along the paver support surface of the plurality of grid substrates and the boundary ridge paver support surface of the at least one boundary ridge grid substrate, and in an installed configuration:

at least one of the plurality of paver pieces bridges across the at least one boundary ridge grid substrate and a grid substrate of the plurality of grid substrates at first laterally movable joints, and at least some of the plurality of paver pieces bridge across proximate grid substrates of the plurality of grid substrates at second laterally movable joints, and the at least one boundary ridge grid substrate, the plurality of grid substrates and the bridging paver pieces form an articulated paver linkage extending from the integrated boundary ridge.

2. The paving system of claim 1, wherein the plurality of grid substrates and the at least one boundary ridge grid substrate include at least one of grid recesses and grid projections configured for coupling with corresponding paver projections and paver recesses of the plurality of paver pieces.

3. The paving system of claim 2, wherein each of the first and second laterally movable joints include at least one grid recess and paver projection or at least one grid projection and paver recess.

4. The paving system of claim 2, wherein the grid projection is smaller than the paver recess and the paver projection is smaller than the grid recess.

5. The paving system of claim 1, wherein the integrated boundary ridge includes a first paver face extending along one or more paver pieces of the plurality of paver pieces coupled along the boundary ridge paver support surface.

6. The paving system of claim 5, wherein the integrated boundary ridge includes a second exterior face directed away from the first paver face.

7. The paving system of claim 6, wherein the second exterior face consists of one of an angled shape, a flat angled shape, flat vertical shape, a concave shape, a convex shape, a ribbed face and a decorative contoured face.

8. The paving system of claim 1, wherein the boundary ridge grid substrate includes at least one integrated stake extending beyond a lower surface of the boundary ridge grid substrate.

9. The paving system of claim 1, wherein the at least one boundary ridge grid substrate includes a plurality of boundary ridge grid substrates.

10. The paving system of claim 1, wherein the at least one boundary ridge grid substrate includes a single boundary ridge grid substrate including a grid substrate orifice configured to extend around the plurality of grid substrates.

11. The paving system of claim 1, wherein the integrated boundary ridge extends along an edge of the at least one boundary ridge grid substrate.

12. A paving system comprising:

a plurality of grid substrates configured for arrangement along a surface, wherein each of the grid substrates of the plurality of grid substrates includes a paver support surface;

at least one boundary grid substrate configured for arrangement along the surface, the at least one boundary grid substrate includes:

a boundary paver support surface, and at least one integrated stake extending beneath the boundary paver support surface; and a plurality of paver pieces configured for coupling along the paver support surface of the plurality of grid substrates and the boundary paver support surface of the at least one boundary grid substrate, and in an installed configuration:

at least one of the plurality of paver pieces bridges across the at least one boundary grid substrate and a grid substrate of the plurality of grid substrates at first laterally movable joints, and at least some of the plurality of paver pieces bridge across proximate grid substrates of the plurality of grid substrates at second laterally movable joints, and the at least one boundary grid substrate, the plurality of grid substrates and the bridging paver pieces form an articulated paver linkage.

13. The paving system of claim 12, wherein the plurality of grid substrates and the at least one boundary grid substrate include at least one of grid recesses and grid projections configured for coupling with corresponding paver projections and paver recesses of the plurality of paver pieces.

14. The paving system of claim 13, wherein each of the first and second laterally movable joints include at least one grid recess and paver projection or at least one grid projection and paver recess.

15. The paving system of claim 13, wherein the grid projection is smaller than the paver recess and the paver projection is smaller than the grid recess.

16. The paving system of claim 12, wherein the boundary grid substrate includes an integrated boundary ridge above the boundary paver support surface.

17. The paving system of claim 12, wherein the at least one integrated stake includes a plurality of integrated stakes.

18. The paving system of claim 12, wherein the integrated stake is proximate an edge of the at least one boundary grid substrate.

19. The paving system of claim 12, wherein the at least one boundary grid substrate includes a plurality of boundary grid substrates.

20. A method of installing a paving system comprising:

forming a composite paver support surface including an integrated boundary ridge, forming the composite paver support surface includes:

arranging a plurality of grid substrates proximately, each of the grid substrates including a component paver support surface, and arranging at least one boundary ridge grid substrate proximate to one or more of the grid substrates, the at least one boundary ridge grid substrate including the integrated boundary ridge above a boundary ridge paver support surface, and the composite paver support surface includes the component paver support surfaces and the boundary ridge paver support surface; and interlocking the plurality of grid substrates and the at least one boundary ridge grid substrate to form an articulated paver linkage, interlocking including:

bridging at least one paver piece across the at least one boundary ridge grid substrate and a grid substrate of the plurality of grid substrates at first laterally movable joints, and bridging paver pieces across proximate grid substrates of the plurality of grid substrates at second laterally movable joints.

21. The method of claim 20, wherein bridging at least one paver piece across the at least one boundary ridge grid substrate and the grid substrate includes at least one of positioning a paver projection within a grid recess or positioning grid projection within a paver recess.

22. The method of claim 20, wherein bridging paver pieces across proximate grid substrates includes at least one of positioning paver projections within grid recesses or positioning grid projections within paver recesses.

23. The method of claim 20 comprising arresting move at least one paver piece of the plurality of paver pieces, arresting including at least one of:

directly or indirectly engaging the at least one paver piece against the integrated boundary ridge, or anchoring the at least one paver piece relative to the other paver pieces of the plurality of paver pieces through distribution of forces incident on the at least one paver piece through the articulated paver linkage.

24. The method of claim 20 comprising staking the at least one boundary ridge grid substrate to an underlying surface with an integrated stake extending from the at least one boundary ridge grid substrate.

25. The method of claim 20 comprising coupling additional paver pieces over the composite paver support surface, the additional paver pieces, the bridging paver pieces and the at least one paver piece forming a paver surface.

* * * * *